US009478165B2

(12) United States Patent
Kitadani et al.

(10) Patent No.: US 9,478,165 B2
(45) Date of Patent: Oct. 25, 2016

(54) ELECTRO-OPTIC DEVICE, METHOD OF DRIVING ELECTRO-OPTIC DEVICE, AND ELECTRONIC APPARATUS

(71) Applicant: SEIKO EPSON CORPORATION, Tokyo (JP)

(72) Inventors: Kazuma Kitadani, Chino (JP); Shin Fujita, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 4 days.

(21) Appl. No.: 14/695,410

(22) Filed: Apr. 24, 2015

(65) Prior Publication Data

US 2015/0228222 A1 Aug. 13, 2015

Related U.S. Application Data

(63) Continuation of application No. 13/826,533, filed on Mar. 14, 2013, now Pat. No. 9,107,247.

(30) Foreign Application Priority Data

Apr. 25, 2012 (JP) ..... 2012-099994

(51) Int. Cl.

| | |
|---|---|
| ***H05B 39/00*** | (2006.01) |
| ***G09G 3/32*** | (2016.01) |
| ***H05B 37/02*** | (2006.01) |

(52) U.S. Cl.

CPC ..... *G09G 3/3225* (2013.01); *G09G 3/3233* (2013.01); *G09G 3/3291* (2013.01); *H05B 37/02* (2013.01); *G09G 2300/0819* (2013.01); *G09G 2300/0861* (2013.01); *G09G 2300/0876* (2013.01); *G09G 2310/0262* (2013.01); *G09G 2310/0297* (2013.01); *G09G 2320/0233* (2013.01); *G09G 2320/043* (2013.01)

(58) Field of Classification Search

CPC ..... G09G 3/3233; G09G 3/3291; G09G 2310/0297

See application file for complete search history.

(56) References Cited

U.S. PATENT DOCUMENTS

| | | | | |
|---|---|---|---|---|
| 7,623,122 | B2 | 11/2009 | Fujita | |
| 8,072,396 | B2 | 12/2011 | Kitazawa et al. | |
| 8,547,304 | B2 * | 10/2013 | Ito | G09G 3/3688 345/76 |
| 9,107,247 | B2 * | 8/2015 | Kitadani | H05B 37/02 |

(Continued)

FOREIGN PATENT DOCUMENTS

| | | | |
|---|---|---|---|
| JP | 2002-333870 | A | 11/2002 |
| JP | 2005-352411 | A | 12/2005 |

(Continued)

*Primary Examiner* — Hai L Nguyen
(74) *Attorney, Agent, or Firm* — Oliff PLC

(57) ABSTRACT

Provided is an electro-optic device including: a first pixel circuit that is provided corresponding to a position where one scanning line and a first data line are intersect with each other; a second pixel circuit that is provided corresponding to a position where the one scanning line and a second data line are intersect with each other; a first level shift unit circuit that shifts electric potential of a first data signal so as to compress electric potential amplitude of the first data signal with a first compression rate, and supplies the signal to the first data line; and a second level shift unit circuit that shifts electric potential of a second data signal so as to compress electric potential amplitude of the second data signal with a second compression rate different from the first compression rate, and supplies the signal to the second data line.

18 Claims, 15 Drawing Sheets

(56) References Cited

U.S. PATENT DOCUMENTS

| | | | |
|---|---|---|---|
| 2002/0047822 | A1 | 4/2002 | Senda et al. |
| 2002/0196208 | A1 | 12/2002 | Nanno et al. |
| 2005/0168490 | A1 | 8/2005 | Takahara |
| 2005/0168491 | A1 | 8/2005 | Takahara et al. |
| 2005/0180083 | A1 | 8/2005 | Takahara et al. |
| 2006/0107143 | A1 | 5/2006 | Kim et al. |
| 2006/0139255 | A1 | 6/2006 | Kim et al. |
| 2010/0045646 | A1 | 2/2010 | Kishi |
| 2011/0050741 | A1 | 3/2011 | Jeong |
| 2011/0109664 | A1 | 5/2011 | Toyomura et al. |

FOREIGN PATENT DOCUMENTS

| | | | |
|---|---|---|---|
| JP | 2006-113162 | A | 4/2006 |
| JP | 2006-113548 | A | 4/2006 |
| JP | 2007-226254 | A | 9/2007 |
| JP | 2007-233398 | A | 9/2007 |
| JP | 2011-053635 | A | 3/2011 |
| JP | 2011-102928 | A | 5/2011 |
| JP | 2011-164425 | A | 8/2011 |
| WO | 20081108024 | A1 | 9/2008 |

* cited by examiner $$C1 = \frac{Cref1 \cdot (Cdt + Cpix)}{Cref1 + Cdt + Cpix} \quad \cdots (1)$$

$$C2 = Cref2 \quad \cdots (2)$$

FIG. 12

$$Vdata \cdot C2 = Vnode \cdot (C1 + C2) - Vref \cdot C1 \quad \cdots (6)$$

$$Vnode = \frac{Vdata \cdot C2 + Vref \cdot C1}{C1 + C2} \quad \cdots (7)$$

$$Vnode = Vref + \Delta Vh \quad \cdots (8)$$

$$\Delta Vh = \frac{Vdata \cdot C2 + Vref \cdot C1}{C1 + C2} - Vref$$

$$= \frac{C2}{C1 + C2} \cdot (Vdata - Vref) \quad \cdots (9)$$

$$= k \cdot (Vdata - Vref) \quad \cdots (10)$$

$$\Delta Vg = \frac{Cref1 \cdot (Cdt + Cpix)}{Cref1 + Cdt + Cpix} \cdot \Delta Vh \quad \cdots (11)$$

$$= p \cdot \Delta Vh \quad \cdots (12)$$

$$= \frac{C1 \cdot C2}{C1 + C2} \cdot (Vdata - Vref) \quad \cdots (13)$$

$$Vg = Vel - |Vth| + p \cdot \Delta Vh \quad \cdots (14)$$

ELECTRO-OPTIC DEVICE, METHOD OF DRIVING ELECTRO-OPTIC DEVICE, AND ELECTRONIC APPARATUS

This is a Continuation of application Ser. No. 13/826,533 filed Mar. 14, 2013, which claims the benefit of Japanese Application No. 2012-099994 filed Apr. 25, 2012. The disclosure of the prior applications is hereby incorporated by reference herein in its entirety.

BACKGROUND

1. Technical Field

The present invention relates to a technology of displaying a color image with a plurality of electro-optic elements, for example.

2. Related Art

In recent years, various electro-optic devices using light emitting elements such as Organic Light Emitting Diode (hereinafter, referred to as "OLED") elements are proposed. The electro-optic devices generally have a configuration in that pixel circuits including the light emitting elements or transistors corresponding to intersection of scanning lines and data lines are provided with correspondence with pixels of an image to be displayed. In such configuration, if a data signal with electric potential according to a gradation level of a pixel is applied to a gate of the transistor, the transistor supplies electric current according to voltage between gate and source to a light emitting element. Accordingly, the light emitting element emits light with brightness according to the gradation level. At that time, if a property such as threshold voltage of a transistor varies for each pixel circuit, display unevenness to lose uniformity on a display screen is generated.

Accordingly, a technology to compensate properties of a transistor of a pixel circuit is proposed (for example, see JP-A-2011-53635).

Meanwhile, in a case of displaying a color image with an electro-optic device, a configuration, in which electro-optic elements correspond to any of RGB, for example, and 1 dot color is realized with light emitting of three electro-optic elements corresponding to RGB, is employed.

SUMMARY

An advantage of some aspects of the invention is to provide a technology to solve problems when displaying a color image.

According to an aspect of the invention, there is provided an electro-optic device, including: a plurality of scanning lines; a plurality of data lines; a first pixel circuit that is provided corresponding to a position where one scanning line of the plurality of scanning lines and a first data line of the plurality of data lines are intersect with each other; a second pixel circuit that is provided corresponding to a position where the one scanning line and a second data line of the plurality of data lines are intersect with each other; a first level shift unit circuit that shifts electric potential of a first data signal so as to compress electric potential amplitude of the first data signal supplied to a first input terminal corresponding to the first data line with a first compression rate, and supplies the signal to the first data line; and a second level shift unit circuit that shifts electric potential of a second data signal so as to compress electric potential amplitude of the second data signal supplied to a second input terminal corresponding to the second data line with a second compression rate different from the first compression rate, and supplies the signal to the second data line, wherein each of the first pixel circuit and the second pixel circuit includes a light emitting element, and a driving transistor that supplies electric current corresponding to voltage between gate and source when the one scanning line is selected, to the light emitting element.

According to the aspect of the invention, even when the electric potential amplitude of the first data signal and the electric potential amplitude of the second data signal are the same with each other, it is possible to differentiate electric potential amplitude when supplying the first signal to the first data line and electric potential amplitude when supplying the second data signal to the second data line from each other.

In the aspect of the invention, a first configuration in that the electro-optic device includes a first holding unit which holds electric potential of the first data line and a second holding unit which holds electric potential of the second data line, the first level shift circuit includes a first capacitance element which is electrically connected between the first input terminal and the first data line, and a third holding unit which holds electric potential of the first input terminal, and the second level shift circuit includes a second capacitance element which is electrically connected between the second input terminal and the second data line, and a fourth holding unit which holds electric potential of the second input terminal, may be employed.

In addition, in the aspect of the invention, a second configuration in that the electro-optic device includes a first holding unit which holds electric potential of the first data line and a second holding unit which holds electric potential of the second data line, the first level shift circuit includes a first capacitance element which is electrically connected between the first input terminal and the first data line, and the second level shift circuit includes a second capacitance element which is electrically connected between the second input terminal and the second data line, may be employed.

In addition, the electro-optic device of the aspect of the invention may further include a demultiplexer that supplies a data signal supplied to a common terminal to the first input terminal in a first period as the first data signal, and supplies the data signal to the second input terminal in a second period different from the first period as the second data signal, and the first pixel circuit and the second pixel circuit may correspond to colors different from each other.

According to the configuration, even when the electric potential amplitude of the first data line and the electric potential amplitude of the second data line are different from each other by corresponding different colors with respect to the first pixel circuit and the second pixel circuit, the configuration of distributing data signals supplied to the common terminal with the demultiplexer may be employed.

In the electro-optic device of the aspect of the invention, it is preferable that the first data signal and the second data signal be obtained by converting digital data with the same bit numbers with each other into analog signals.

In doing so, even when the electric potential amplitude of the first data line and the electric potential amplitude of the second data line are different from each other, it is possible to share a D/A converter which converts digital data into an analog signal.

In addition, in other aspects of the invention, other than the electro-optical device, a method of driving an electro-optic device, or an electronic apparatus which includes the electro-optic device may be used. As the electronic apparatus, a display device such as a Head Mounted Display (HMD) or an electron view finder, is typically used.

BRIEF DESCRIPTION OF THE DRAWINGS

The invention will be described with reference to the accompanying drawings, wherein like numbers reference like elements.

FIG. 12 is a view showing electric potential of each unit of various capacitance items.

DESCRIPTION OF EXEMPLARY EMBODIMENTS

Hereinafter, an embodiment of the invention will be described with reference to the drawings.

Figure 1:
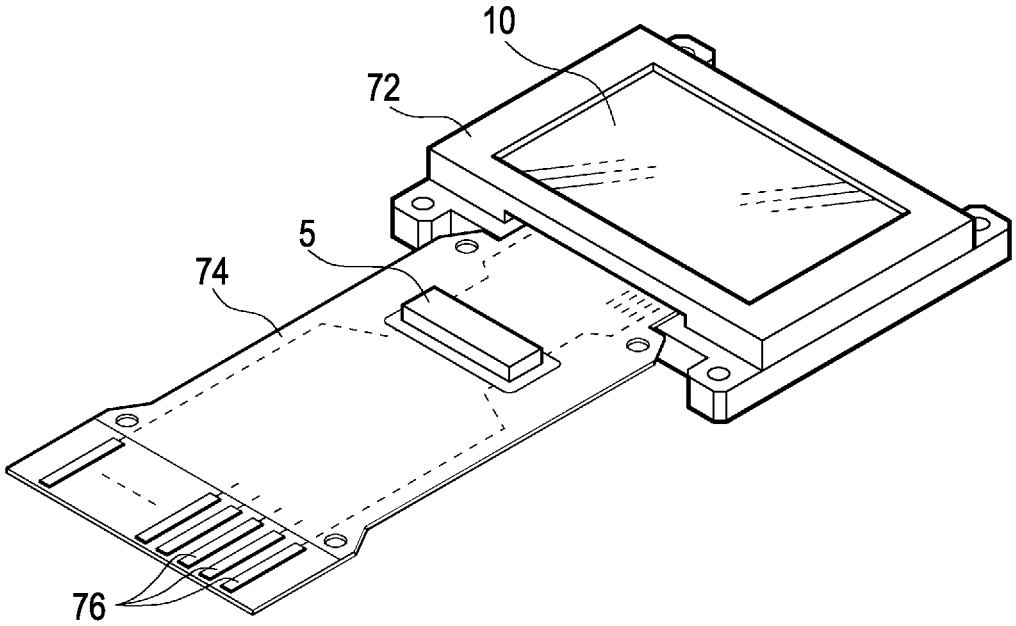
FIG. 1 is a perspective view showing a configuration of an electro-optic device according to an embodiment of the invention.

FIG. 1 is a perspective view showing a configuration of an electro-optic device 10 according to an embodiment of the invention.

The electro-optic device 10 is a micro display which displays a color image in a Head Mounted Display (HMD), for example. The electro-optic device 10 will be described later in detail, but, is an organic EL device in which a plurality of pixel circuits, driving circuits which drives the pixel circuits, and the like are formed on a semiconductor silicon substrate, for example, and an OLED which is an example of a light emitting element is used for the pixel circuits.

The electro-optic device 10 is accommodated in a frame-shaped case 72 which opens in a display region, and is connected with one end of a Flexible Printed Circuit (FPC) substrate 74. A plurality of terminals 76 are provided on the other end of the FPC substrate 74, and the other end thereof is connected to an upper circuit (not shown). A control circuit 5 of a semiconductor chip is mounted on the FPC substrate with a Chip on Film (COF) technology, and image (moving image) data is synchronized with a synchronization signal and supplied from the upper circuit through the plurality of terminals 76. The synchronization signal includes a vertical synchronization signal, a horizontal synchronization signal, or a dot clock signal. In addition, the image data has a gradation level of a pixel of an image to be displayed regulated with 8 bits for each RGB, for example.

The control circuit 5 is a control circuit including both functions of a power supply circuit and a data signal output circuit of the electro-optic device 10. That is, in addition to supplying various control signals or various electric potential items (voltage) generated according to an synchronization signal to the electro-optic device 10, the control circuit 5 also converts digital image data into an analog data signal and supplies the signal to the electro-optic device 10.

An OLED corresponds to any of R (red), G (green), and B (blue), and realizes 1 dot of a color image to be displayed with three pixels adjacent to each other. That is, in the embodiment, a configuration in that the color of 1 dot is realized with additive color mixing by light emitting of the OLED corresponding to RGB, is employed.

Description of a detailed structure of the OLED will be omitted, but, to be brief, it has a configuration in that a white organic EL layer is interposed between a pixel electrode (anode) provided individually for each pixel circuit and a common electrode (cathode) which has optical transparency commonly over all pixel circuits. In addition, a color filter corresponding to any of RGB is overlapped on an output side (cathode side) of the OLED. In such OLED, if electric current flows from the anode to the cathode, white light generates in the organic El layer. The white light generated at that time transmits the cathode, is subjected to coloring with the color filter, and visually recognized to an observer side.

In such structure, although the same electric current flows between the anode and the cathode of the OLED by applying uniform voltage over RGB, it is difficult to realize white color (gray color). The reason thereof is mainly because relative luminous efficiencies for each wavelength band of RGB are different from each other. In detail, it is because that, although physical brightness of RGB is constant, the relative luminous efficiencies which are felt to be bright by a human are different in order of G>R>B. Accordingly, in a case of realizing white color with light emitting of the OLED, it is necessary to improve applied voltage when the OLED emits light with maximum brightness in order of B>R>G, inversely with the relative luminous efficiencies.

In addition to the relative luminous efficiencies, as a reason of different applied voltage to the OLED for each RGB, differences of optical properties (a wavelength/transmittance property, a cut-off frequency of the property, and the like) of the color filters to be applied for each RGB may be exemplified.

As is well known, the applied voltage to the OLED, that is, the electric current flowing in the OLED is determined by electric potential of a data line when a scanning line is selected, in detail, voltage between the gate and the source of the transistor which supplies the electric current to the OLED. Accordingly, in a case of improving the applied voltage when the OLED emits light with maximum brightness in order of B>R>G, electric potential amplitude of the data line, in detail, sizes of amplitude from electric potential of the data line in a darkest state to electric potential of the data line in a brightest state become in order of B>R>G.

Herein, when realizing 256 gradations (16,770,000 colors when seen with 1 dot) by regulating the gradation level of the pixel of the image to be displayed with 8 bits, for example, for each RGB, the electric potential to the data line, that is, the electric potential of the gate of the transistor is necessary to engraved with 256 gradations for each RGB.

As described above, electric potential amplitude of the data line are different for each RGB. Accordingly, in a case of sharing the D/A converter which converts the image data of RGB into analog signals with RGB, it is configured to regulate the maximum amplitude to have, for example, 10 bits which is larger than 8 bits, so as to engrave with 256 gradations for the minimum amplitude of the electric potential of the data line.

Figure 17:
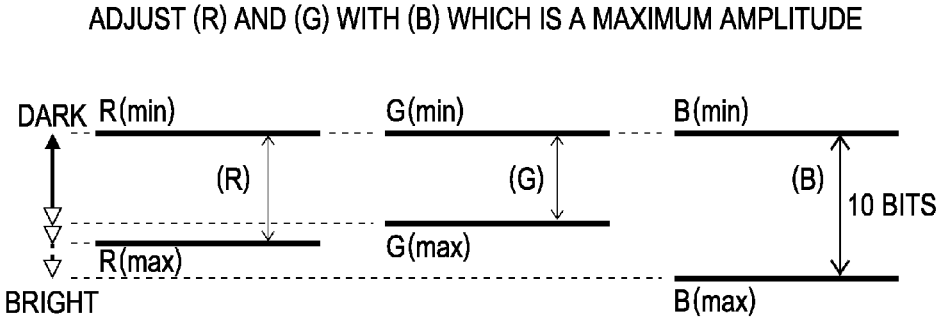
FIG. 17 is a view showing necessary voltage in an OLED for each RGB.

In detail, as shown in FIG. 17, in order to be engraved with 256 gradations even with the minimum amplitude of G (green), in the electric potential (electric potential of the gate of the transistor) of the data line, it is configured to regulate the maximum amplitude of B (blue) to have, for example, 10 bits (1024 gradations) which is larger than 8 bits, and 256 gradations corresponding to the gradation level is selected among them. In R (red) and G (green), 256 gradations corresponding to the gradation level is suitably selected from the amplitude regulated with 10 bits (1024 gradations).

In addition, in FIG. 17, electric potential of the data line corresponding to a gradation level "0" (minimum brightness) is denoted as R (min), G (min), and B (min), for each RGB. Further, the electric potential of the data line corresponding to a gradation level "255" (maximum brightness) is denoted as R (max), G (max), and B (max) for each RGB. Herein, a reason of R (min)>R (max), G (min)>G (max), B (min)>B (max) when seen with the electric potential, is because a transistor which controls the electric current flowing in the OLED which will be described later is set as P-channel type.

However, in such configuration, it is necessary to convert the digital data items with 8 bits which regulates the gradation level of RGB into 10 bits, respectively, before analog conversion with the D/A converter. A configuration to reference Look Up Table in which corresponding relationships before and after the conversion is previously stored is general for the bit conversion.

However, in such configuration, not only three types of RGB are necessary for the Look Up Table, but a transmission path with 10 bits is also necessary, and the configuration becomes complicated.

Herein, in the embodiment, the gradation levels of RGB are set commonly with 8 bits, and the electric potential amplitude of the data signal which is converted from the digital data with 8 bits is shifted and supplied to the data line so as to compress with rate different according to the applied voltage to the OLED for each RGB.

Figure 2:
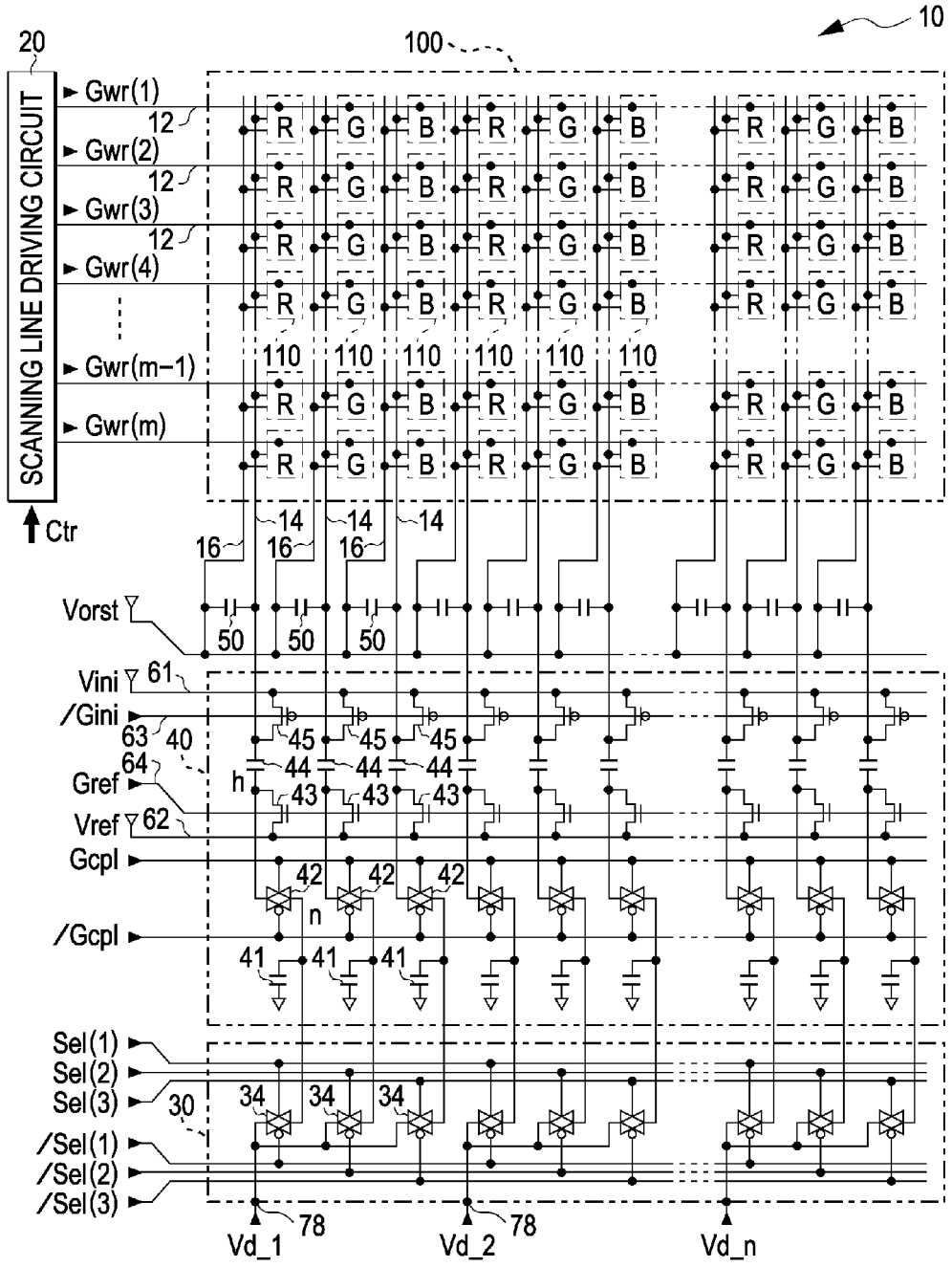
FIG. 2 is a view showing a configuration of the electro-optic device.

FIG. 2 is a view showing a configuration of the electro-optic device 10 according to the embodiment. As shown in the drawing, the electro-optic 10 mainly divided into a scanning line driving circuit 20, a demultiplexer 30, a level shift circuit 40, and a display unit 100.

Among them, pixel circuits 110 corresponding to pixels of the image to be displayed are arranged in matrix in the display unit 100. In detail, in the display unit 100, scanning lines 12 in m rows are provided to extend in a horizontal direction in the drawing, and data lines 14 in (3n) columns grouped with three columns are provided to extend in a vertical direction in the drawing and to intersect with each scanning line 12 while maintaining electric insulation. In addition, the pixel circuits 110 are provided in positions corresponding to intersection of the scanning lines 12 in m rows and data lines 14 in (3n) columns.

Herein, both m and n are natural numbers. In the matrix of the scanning lines 12 and the pixel circuits 110, in order to differentiate the rows, they are called 1, 2, 3, . . . , (m−1)-th, and m-th rows, sequentially from the top of the drawing, in some cases. In the same manner, in order to differentiate columns of matrix of the data lines 14 and the pixel circuits 110, they are called 1, 2, 3, . . . , (3n−1)-th, and (3n)-th columns, sequentially from left of the drawing, in some cases. In addition, if an integer j equal to or more than 1 and equal to or less than n is used for describing by generalizing the group of the data lines 14, j-th group counted from the left includes data lines 14 in (3j−2)-th column, (3j−1)-th column, and (3j)-th column.

In addition, three pixel circuits 110 corresponding to intersection of the scanning line 12 in the same row and data lines 14 in third column belonged to the same group correspond to pixels of R, G, B, respectively. Accordingly, in the embodiment, a matrix array of the pixel circuits 110 is vertical m row×horizontal (3n) column, and when seen from a dot array of the display image, an array is vertical m row×horizontal n column.

For convenience, when the data line 14 in (3j−2)-th column corresponding to R is set as a first data line, for example, the data line 14 in (3j−1)-th column corresponding to G is called a second data line, in some cases. In the pixel circuits 110, a pixel circuit corresponding to the data line 14 of R (first data line) is a first pixel circuit, and a pixel circuit corresponding to the data line 14 of G (second data line) is a second pixel circuit.

Control signals to be described below is supplied to the electro-optic device 10 by the control circuit 5. In detail, a control signal Ctr which controls the scanning line driving circuit 20, control signals Sel(1), Sel(2), and Sel(3) which control selection in the demultiplexer 30, control signals /Sel(1), /Sel(2), and /Sel(3) which are in logical inversion relation with respect to the above signals, control signals /Gini, Gref, and Gcp1 which control the level shift circuit 40, and a control signal /Gcp1 which is in logical inversion relation of the control signal Gcp1 are supplied to the electro-optic device 10. In addition, in practice, the control signal Ctr includes a plurality of signals such as a pulse signal, a clock signal, an enable signal, and the like.

In addition, data signals Vd_1, Vd_2, . . . , and Vd_n are supplied from the control circuit 5 to the electro-optic device 10 through the common terminals 78 corresponding to 1, 2, . . . , and n-th groups, according to selection timing in the demultiplexer 30.

Herein, in the embodiment, when the gradation levels which regulate the gradations of the pixel of the image to be displayed are designated in a range from darkest level 0 to brightest level 255, for example, the data signals Vd_1 to Vd_n can be obtained in stages in a range from electric potential V(0) corresponding to level 0 to electric potential V(255) corresponding to level 255. Herein, since the transistor which controls the electric current flowing in the OLED is P-channel type, as the bright gradation level is designated, the electric potential of the data signal is degraded from electric potential V(0). In addition, for convenience of description, electric potential of a data signal in a case where a gradation level is designated as "s", is denoted as V(s). Herein, s is any of 0, 1, 2, 3, . . . , and 255.

In addition, a holding capacitor 50 is provided for each data line 14. One end of the holding capacitor 50 is connected to the data line 14, and the other end of the holding capacitor 50 is commonly connected to a feeder line 16 of the fixed electric potential, for example, electric potential Vorst. Accordingly, the holding capacitor 50 functions as a holding unit which holds the electric potential of the data lines 14.

In addition, when differentiating in columns, a holding capacitor 50 corresponding to the data line 14 of R (first data line) is a first holding unit, and a holding capacitor 50 corresponding to the data line 14 of G (second data line) is a second holding unit.

As the holding capacitor 50, capacitance parasitic to the data lines 14 may be used, and the parasitic capacitance and synthetic capacitance which is formed by interposing an insulating body (dielectric body) between wiring configuring the data lines 14 and the other wiring may be used. Herein, the capacitance of holding capacitor 50 is set as Cdt.

The scanning line driving circuit 20 generates scanning signals for scanning the scanning lines 12 sequentially for each one row over a frame period, according to the control signal Ctr. Herein, scanning lines to be supplied to the 1, 2, 3, . . . , (m−1)-th, and (m−1)-th scanning lines 12 are denoted as Gwr(1), Gwr(2), Gwr(3), . . . , Gwr(m−1), and Gwr(m).

In addition to the scanning signals Gwr(1) to Gwr(m), the scanning line driving circuit 20 generates various control signals synchronized with the scanning lines for each row and supplies the signals to the display unit 100, however this is omitted in FIG. 2. In addition, the frame period is a period necessary for the electro-optic device 10 to display an image for one cut (frame), and if a frequency of the vertical synchronization signal included in the synchronization signal is 120 Hz, for example, the frame period is 8.3 milliseconds for one cycle thereof.

The demultiplexer 30 is an aggregate of transmission gates 34 provided for each column. Input ends of transmission gates 34 corresponding to (3j−2)-th column, (3j−1)-th column, and (3j)-th column belonged to the j-th group are connected to common terminals 78, and data signals Vd_j are supplied with time division.

The transmission gate 34 provided in the (3j−2)-th column which is the left end column in the j-th group is turned on at the time of a first period in which the control signal Sel(1) is in H level (control signal /Sel(1) is in L level). In the same manner, the transmission gate 34 provided in the (3j−1)-th column which is the center column in the j-th group is turned on at the time of a second period in which the control signal Sel(2) is in H level (control signal /Sel(2) is in L level), and the transmission gate 34 provided in the (3j)-th column which is the right end column in the j-th group is turned on when the control signal Sel(3) is in H level (when the control signal /Sel(3) is in L level).

The level shift circuit 40 shifts electric potential of data signals in a direction to compress the electric potential amplitude of the data signals to be output from output end of the transmission gate 34 of each column. Accordingly, the level shift circuit 40 includes a set of a holding capacitor 41, a transmission gate 42, an N-channel type transistor 43, a holding capacitor 44, and a P-channel type transistor 45, for each column.

In addition, when differentiating the level shift circuits 40 with columns, the holding capacitor 41, the transmission gate 42, the transistor 43, the holding capacitor 44, and the transistor 45 corresponding to the R column are a first level shift unit circuit, and those corresponding to the G column are a second level shift unit circuit.

The output end of the transmission gate 34 of the demultiplexer 30 in each column is connected to a node n in each column of the level shift circuit 40. Herein, the node n is a connection point of one end of the holding capacitor 41, and the input end of the transmission gate 42 of the level shift circuit 40.

In addition, when differentiating the nodes n with the columns, a node n corresponding to R column is a first input terminal, and a node n corresponding to G column is a second input terminal.

The other ends of the holding capacitors 41 are commonly connected to Gnd which is fixed electric potential in each column. When differentiating with columns, the holding capacitor 41 corresponding to the data line 14 of R (first data line) is a third holding unit, and the holding capacitor 41 corresponding to the data line 14 of G (second data line) is a fourth holding unit. For convenience of description, capacitance of the holding capacitor 41 is Cref2.

For voltage, the electric potential Gnd is set as a reference of zero volt, unless otherwise noted as both end voltage of the holding capacitor, the voltage between the gate and the source, the voltage between the anode and the cathode of the OLED 130.

The transmission gate 42 in each column is turned on when the control signal Gcp1 is in H level (when the control signal /Gcp1 is in L level). The output ends of the transmission gates 42 are connected to the data lines 14 through the holding capacitors 44.

Herein, for convenience, one end of the holding capacitor 44 is set as a data line 14 side, and the other end thereof is set as a transmission gate 42 side. At that time, one end of the holding capacitor 44 is also connected to a drain node of the transistor 45, in addition to the data line 14, and meanwhile, the other end of the holding capacitor 44 is also connected to a drain node of the transistor 43. Herein, for convenience of description, capacitance of the holding capacitor 44 is set as Cref1, and the other end of the holding capacitor 44 is set as a node h. In addition, when differentiating the holding capacitors 44 with columns, the holding capacitor corresponding to the R column is set as a first capacitance element, and the holding capacitor corresponding to the G column is set as a second capacitance element.

In transistors 43, source nodes are commonly connected to a feeder line 62 which feeds electric potential Vref as predetermined reference electric potential over each column, and gate nodes are commonly connected to a control line 64 to which the control signal Gref is supplied over each column. Accordingly, while the node h and the feeder line 62 are electrically connected to each other by turning on the transistor 45 when the control signal Gref is in H level, the node h and the feeder line 62 are electrically disconnected from each other by turning off the transistor 45 when the control signal Gref is in L level.

In addition, in the transistor 45, source nodes are commonly connected to the feeder line 61 which feeds electric potential Vini as initial electric potential over each column, and gate nodes are commonly connected to the control line 63 to which the control signal /Gini is supplied over each column. Accordingly, while the data line 14 and the feeder line 61 are electrically connected to each other by turning on the transistor 45 when the control signal /Gini is in L level, the data line 14 and the feeder line 61 are electrically disconnected from each other by turning off the transistor 45 when the control signal /Gini is in H level.

In the embodiment, the scanning line driving circuit 20, the demultiplexer 30, and the level shift circuit 40 are divided for convenience, however, it is possible to consider those collectively as a driving circuit which drives the pixel circuits 110.

The pixel circuit 110 will be described with reference to FIG. 3. Since each of the pixel circuit 110 has the same configuration electrically, herein, a pixel circuit 110 in i-th row by (3j−2)-th column which positions in i-th row by (3j−2)-th column which is the left end column of the j-th group will be described as an example.

In addition, i is a reference signal when generally showing a row in which the pixel circuit 110 is arranged, and is an integer equal to or more than 1 and equal to or less than m.

Figure 3:
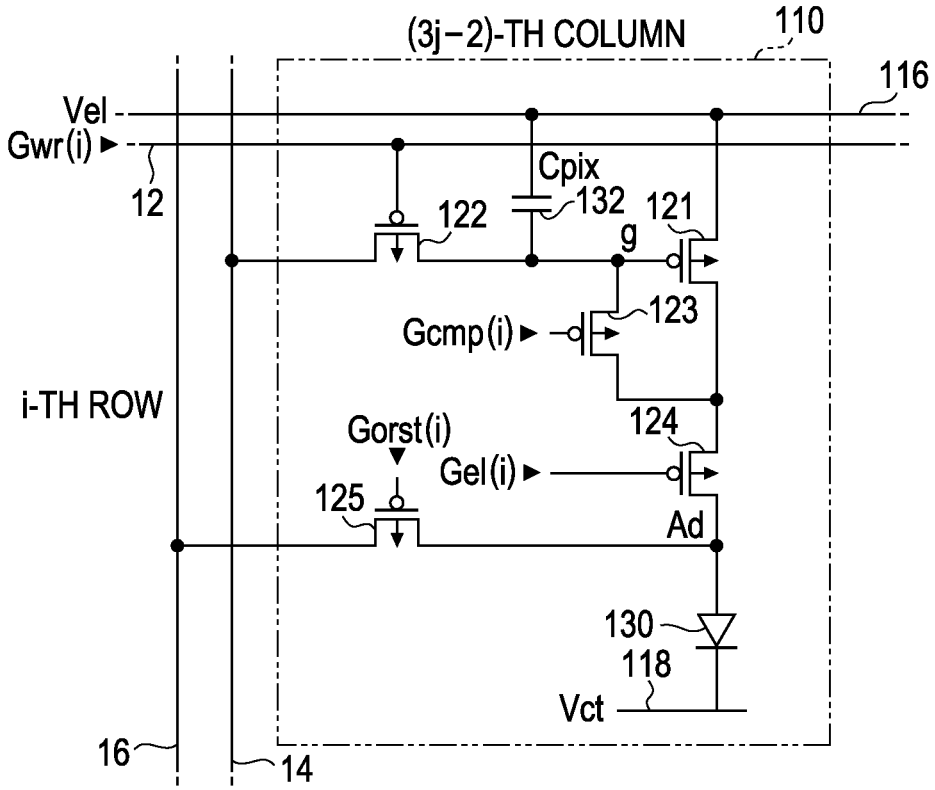
FIG. 3 is a view showing a pixel circuit of the electro-optic device.

As shown in FIG. 3, the pixel circuit 110 includes P-channel type transistors 121 to 125, the OLED 130, and a holding capacitor 132. A scanning signal Gwr(i), and control signals Gel(i), Gcmp(i), and Gorst(i) are supplied to the pixel circuit 110. Herein, the scanning signal Gwr(i), and the control signals Gel(i), Gcmp(i), and Gorst(i) correspond to the i-th row, respectively, and are supplied by the scanning line driving circuit 20. Accordingly, if the scanning signal Gwr(i), and the control signals Gel(i), Gcmp(i), and Gorst(i) are in i-th row, the signals are also commonly supplied to pixel circuits in other columns, other than the (3j−2)-th column as an example herein. In addition, a scanning signal and control signals corresponding to each row are supplied to the pixel circuits 110 other than the i-th row.

In the pixel circuit 110 in the i-th row by the (3j−2)-th column, the transistor 122 corresponds to a selection transistor, a gate node thereof is connected to the scanning line 12 in the i-th row, one of a drain and source nodes is connected to the data line 14 in the (3j−2)-th column, and the other end thereof is connected to each of the gate node of the transistor 121, one end of the holding capacitor 132, and the drain node of the transistor 123. Herein, the gate node of the transistor 121 is denoted as g to differentiate with the other node.

In the transistor 121, the source node is connected to the feeder line 116, and the drain node is connected to each of the source node of the transistor 123 and the source node of the transistor 124. Herein, electric potential Vel which is in high potential side of the power supply in the pixel circuit 110 is fed to the feeder line 116.

In addition, the drain node of the transistor 121 is electrically connected to an anode Ad of the OLED 130 through the transistor 123. When the transistor 121 is operated in a saturated region, the transistor 121 supplies electric current corresponding to the voltage between the gate and the source to the OLED 130.

Accordingly, the transistor 121 corresponds to a driving transistor.

The control signal Gcmp(i) is supplied to the gate node of the transistor 123.

In the transistor 124, the control signal Gel(i) is supplied to the gate node, and the drain node is connected to each of the source node of the transistor 125 and the anode Ad of the OLED 130.

In the transistor 125, the control signal Gorst(i) corresponding to the i-th row is supplied to the gate node, and the drain node is connected to the feeder line 16 which feeds the electric potential Vorst.

In addition, in the transistors 121 to 125, it has been described that the drain node or the source node is electrically connected to the other constituent element, however, when the electric potential relationship is changed, the node described as the drain node may be set as the source node, and the node described as the source node may be set as the drain node. For example, one of the source node and the drain node of the transistor 121 may be electrically connected to the feeder line 116, and the other one may be electrically connected to the anode Ad of the OLED 130 through the transistor 123.

The other end of the holding capacitor 132 is connected to the feeder line 116. Accordingly, the holding capacitor 132 holds the voltage between the gate and the source of the transistor 121. Herein, capacitance of the holding capacitor 132 is denoted as Cpix.

In addition, for the holding capacitor 132, capacitance parasitic to the gate node g of the transistor 121 may be used, or capacitance which is formed by interposing an insulating layer with conductive layers different from each other in the silicon substrate may be used.

Further, since the electro-optic device 10 is formed on the silicon substrate in the embodiment, substrate potential of the transistor 121 to 125 is set as electric potential Vel, however, omitted in FIG. 3.

In the pixel circuit 110, the anode Ad of the OLED 130 is a pixel electrode individually provided for each pixel circuit 110. Meanwhile, the cathode of the OLED 130 is a common electrode 118 which is common over all of the pixel circuits 110, and maintains electric potential Vct which is a low potential side of the power supply in the pixel circuit 110.

The OLED 130 is an element in which the white organic EL layer is interposed between the anode and the cathode having optical transparency in the silicon substrate, and a color filter with corresponding color from the RGB is overlapped on the output side (cathode side) of the OLED 130. In such OLED 130, when electric current flows from the anode to the cathode, a hole injected from the anode and an electron injected from the cathode are recombined in the organic EL layer to generate an exciter, and white light is generated. The white light generated at that time is configured to transmit the cathode on the side opposite to the silicon substrate (anode), be subjected to coloring with the color filter to be visually recognized to an observer side.

Herein, as a stage before describing electric potential shift of data signals, the equivalent circuit from the node n of the level shift circuit 40 to the data line 14 and the gate node g will be described.

Figures 9, 10:
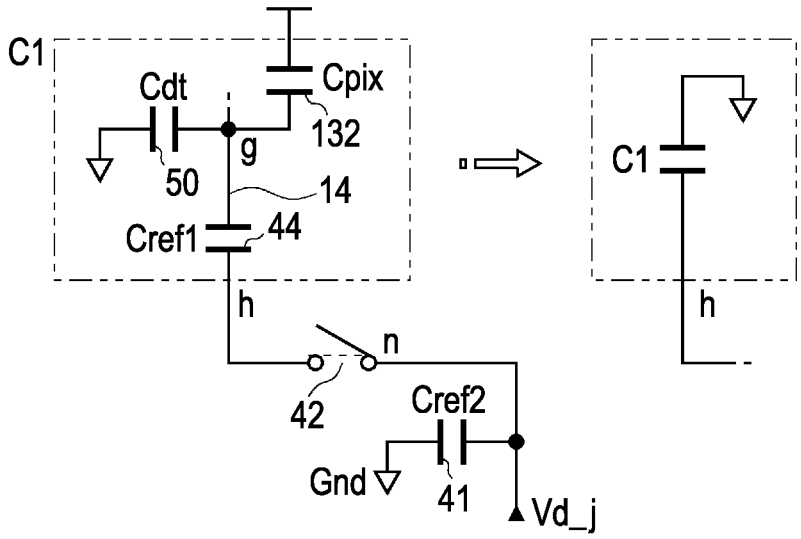
FIG. 9 is a view showing an equivalent circuit in periphery of a data line of the electro-optic device.
FIG. 10 is a view showing various capacitance items of the equivalent circuit.

FIG. 9 is a view showing equivalent circuits of the level shift circuit 40, the data line 14, and the pixel circuit 110 in a period in which the transmission gate 34 in the (3j−2)-th column (see FIG. 2) is turned off and the transistor 122 of the pixel circuit 110 in the i-th row by the (3j−2)-th column is turned on, that is, a compensation period which will be described later.

As shown in the drawing, the holding capacitor 132 of the pixel circuit 110 and the holding capacitors 44 and 50 in the (3j−2)-th column can be denoted as synthetic capacitance C1. Herein, the synthetic capacitance C1 can be expressed as Equation (1) in FIG. 10 using the capacitance Cref1 of the holding capacitor 44, the capacitance Cdt of the holding capacitor 50, and the capacitance Cpix of the holding capacitor 132.

In addition, the capacitance Cpix is small to be ignored compared to the capacitance Cref1 and Cdt, in some cases. In this case, it is possible to approximate the capacitance C1 shown in Equation (1) to Cref1·Cdt/(Cref1+Cdt).

In addition, for convenience, the capacitance Cref2 of the holding capacitor 41 of the level shift circuit 40 is set to be equal to C2 as Equation (2) in FIG. 10.

In the embodiment, as in the following Equation (3), k is shown as a ratio of the capacitance C2 with respect to the sum of the synthetic capacitance C1 and the capacitance C2.

$$k=C2/(C1+C2) \quad (3)$$

Operation of Embodiment

Figure 4:
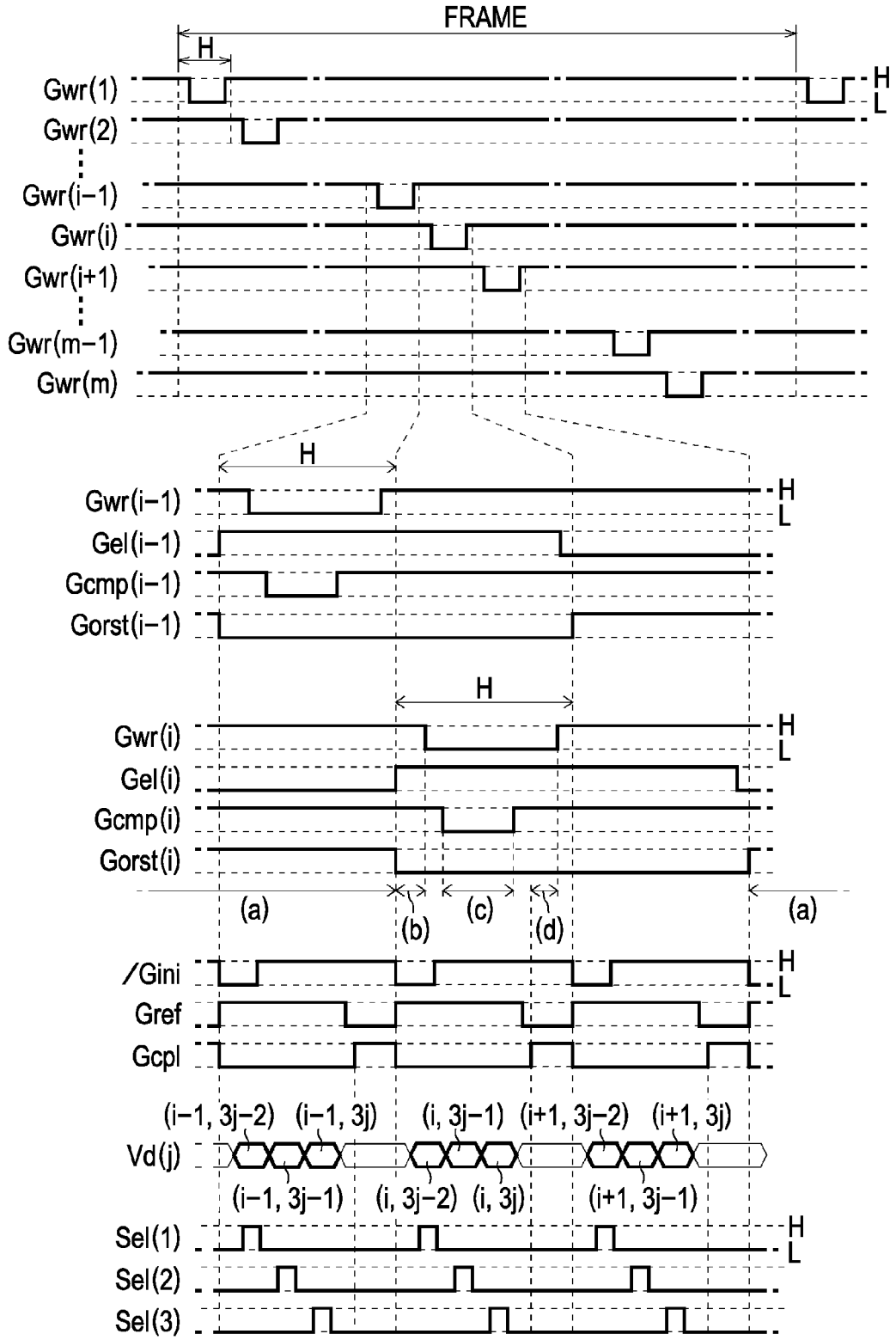
FIG. 4 is a timing chart showing an operation of the electro-optic device.

Operations of the electro-optic device 10 will be described with reference to FIG. 4. FIG. 4 is a timing chart which illustrates operations of each unit of the electro-optic device 10.

As shown in the drawing, the scanning signals Gwr(1) to Gwr(m) are sequentially switched to L level and the scanning lines 12 in 1 to m-th row in one frame are sequentially scanned for each one horizontal scanning period (H).

The operation in one horizontal scanning period (H) is common over the pixel circuits 110 of each row. Hereinafter, in the scanning period in which i-th row is horizontally scanned, an operation will be described by focusing particularly on the pixel circuit 110 in i-th row by (3j−2)-th column.

As shown in FIG. 4, the scanning period in the i-th row in the embodiment is broadly divided into an initialization period shown as (b), a compensation period shown as (c), and a writing period shown as (d). After the writing period of (d), a period after an interval is a light emitting period shown as (a), and after passing period of one frame, a period reaches to the scanning period in i-th row again. Accordingly, in order of time, a cycle of (light emitting period) →initialization period→compensation period→writing period→(light emitting period) is repeated.

In addition, in FIG. 4, a scanning signal Gwr(i−1) and control signals Gel(i−1), Gcmp(i−1), and Gorst(i−1) corresponding to the (i−1)-th row which is prior to the i-th row for one row, have waveforms which is temporally prior to the scanning signal Gwr(i) and the control signals Gel(i), Gcmp (i), and Gorst(i), respectively, for one horizontal scanning period (H).

Light Emitting Period

For convenience of description, the light emitting period which is a precondition for the initialization period will be described, first. As shown in FIG. 4, the scanning signal Gwr(i) is in H level in the light emitting period in the i-th row. In addition, from the control signals Gel(i), Gcmp(i), and Gorst(i) which is logic signals, the control signal Gel(i) is in L level and the control signals Gcmp(i) and Gorst(i) are in H level.

Figure 5:
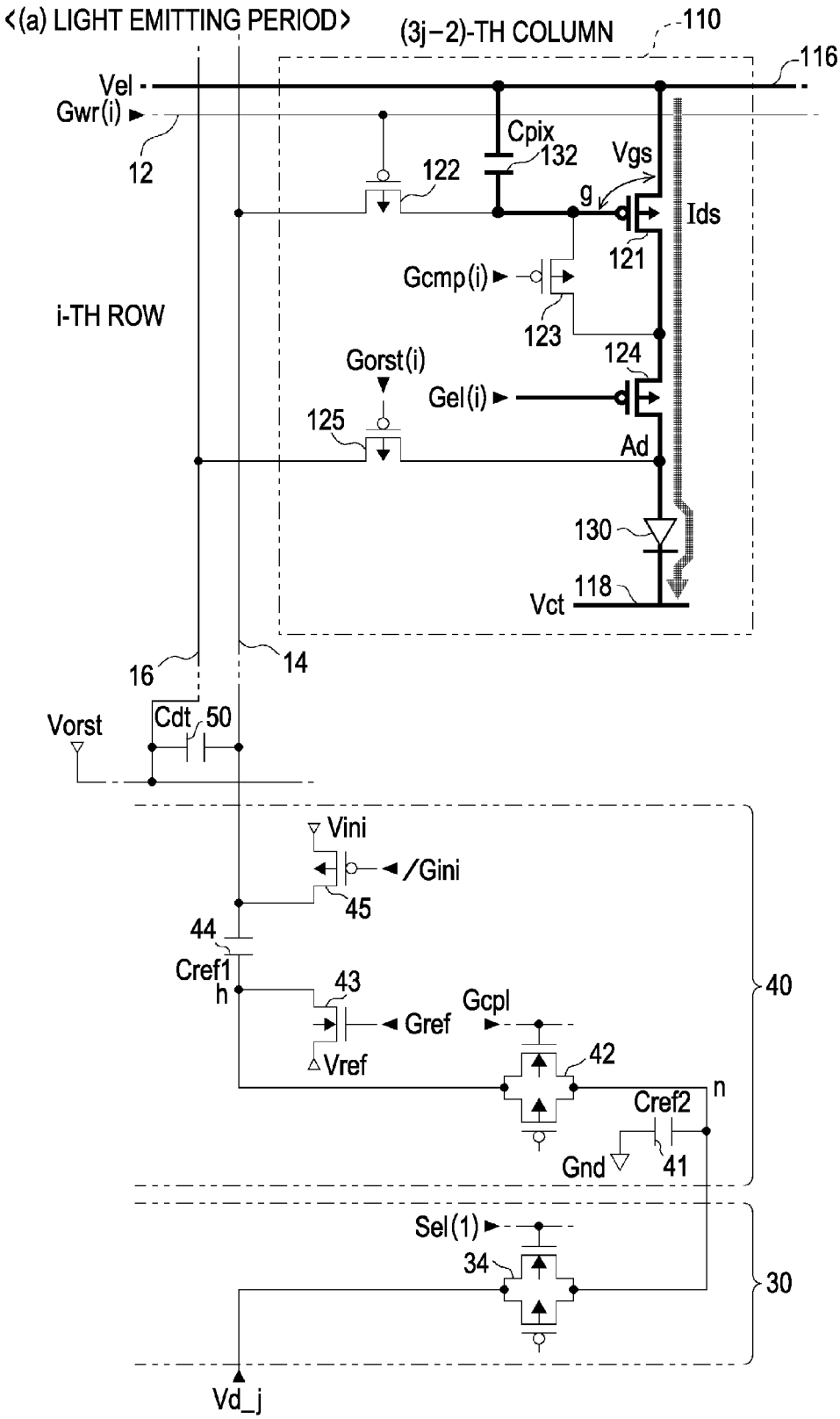
FIG. 5 is an explanatory view of an operation of the electro-optic device.

Accordingly, in the pixel circuit 110 in the i-th row by the (3j−2)-th column as shown in FIG. 5, the transistor 124 turns on, and on the other hand, the transistors 122, 123, and 125 are turned off. Accordingly, electric current Ids corresponding to voltage Vgs between the gate and the source of the transistor 121 is supplied to the OLED 130. In the embodiment as will be described later, the voltage Vgs in the light emitting period is a value obtained by shifting from a threshold voltage of the transistor 121 by an amount corresponding to shift amounts of the electric potential of the node h, and the shift amounts of the electric potential of the node h is determined by the electric potential of the data signal and the constant electric potential Vref. Accordingly, the electric current corresponding to the gradation level is supplied to the OLED 130 in a state in which the threshold voltage of the transistor 121 is compensated.

In addition, in the light emitting period in the i-th row, since the period in rows other than the i-th row is a period of horizontal scanning, the electric potential of the data line 14 is suitable fluctuated. However, in the pixel circuit 110 in the i-th row, since the transistor 122 is turned off, it is not necessary to consider the fluctuation of the electric potential of the data line 14, herein.

In addition, in FIG. 5, channels which are important in the description of the operation are shown with a heavy line (same as in FIGS. 6 to 8 below).

Initialization Period

When approaching next scanning period in the i-th row, the initialization period of (b) starts. As shown in FIG. 4, compared to the light emitting period of (a), in the initialization period of (b), the control signal Gel(i) and the control signal Gorst(i) are changed into H level and L level, respectively.

Figure 6:
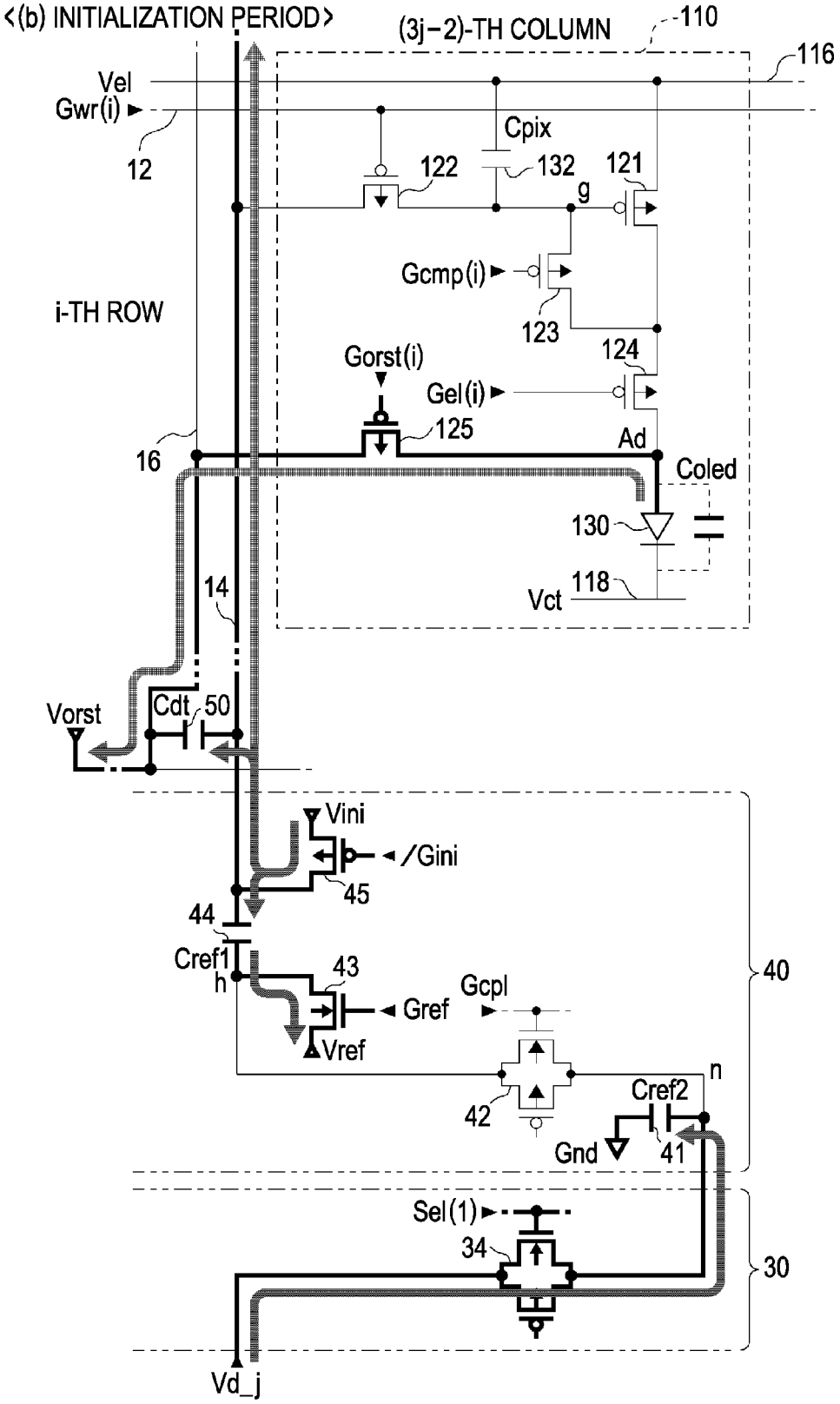
FIG. 6 is an explanatory view of an operation of the electro-optic device.

Accordingly, as shown in FIG. 6, in the pixel circuit 110 in the i-th row by the (3j−2)-th column, the transistor 124 is turned off and the transistor 125 is turned on. Accordingly, the path of the electric current Ids supplied to the OLED 130 is blocked, and the anode Ad of the OLED 130 is reset to the electric potential Vorst.

As described above, since the OLED 130 has a configuration to interpose the organic EL layer between the anode Ad and the cathode, capacitance Coled parasitizes in parallel between the anode and the cathode, as shown with a broken line in the drawing. When the electric current flows to the OLED 130 in the light emitting period, the both end voltage between the anode and the cathode of the OLED 130 is held by the capacitance Coled, however this holding voltage is reset by turning on the transistor 125. Accordingly, in the embodiment, when the electric current flows to the OLED 130 again in the later light emitting period, it is difficult to have an effect of the voltage held by the capacitance Coled.

In detail, in a case of employing a configuration to not perform the reset when changing from a display state with high brightness to a display state with low brightness, for example, since high voltage when the brightness is high, that is, when great electric current flows, is held by the capacitance Coled, although it is desired to flow small electric current after that, it is difficult to realize the aimed display state with low brightness as excess electric current flows. On the other hand, in the embodiment, since the electric potential of the anode Ad of the OLED 130 is reset by turning on the transistor 125, it is easy to realize the aimed display state with low brightness.

In addition, in the embodiment, the electric potential Vorst is set so that difference between the electric potential Vorst and the electric potential Vct of the common electrode 118 is lower than light emitting threshold voltage of the OLED 130. Accordingly, the OLED 130 is in a turned off (non-light emitting) state in the initialization period (compensation period and writing period which will be described later).

Meanwhile, in the initialization period, the control signal /Gini is in L level, the control signal Gref is in H level, and the control signal Gcp1 is in L level (control signal /Gcp1 is in H level). Accordingly, in the level shift circuit 40, the transistors 45 and 43 are turned on and the transmission gate 42 is turned off, as shown in FIG. 6. Thus, the data line 14 which is one end of the holding capacitor 44 is initialized to the electric potential Vini, and the node h which is the other end of the holding capacitor 44 is initialized to the electric potential Vref, respectively.

In addition, in the embodiment, the electric potential Vref is set so as to be equivalent to the electric potential V(0) which is the highest value of the data signal.

$$V(0)=V\mathrm{ref} \tag{4}$$

In addition, in the embodiment, the control circuit 5 supplies the data signal in a period from the initialization period of (b) to the compensation period of (c) as follows.

That is, in a case of the j-th group, the control circuit 5 sequentially switches the data signal Vd_j to the electric potential which is obtained by converting the digital data with 8 bits which regulates the gradation levels of the pixels in the i-th row by (3j−2)-th column, the i-th row by (3j−1)-th column, and the i-th row by (3j)-th column, and meanwhile, the control signals Sel(1), Sel(2), and Sel(3) are sequentially becomes to be in H level exclusively according to the switch of the electric potential of the data signal. Accordingly, in the demultiplexer 30, the transmission gate 34 in each group is turned on in order from the left end column, the center column, and the right end column, respectively.

Herein, in the initialization period, in a case where the transmission gate 34 which is in the left end column belonged to the j-th group is turned on by the control signal Sel(1), as shown in FIG. 6, the data signal Vd_j is supplied to the node n which is one end of the holding capacitor 41, and is held by the holding capacitor 41.

In addition, in the initialization period (and later compensation period), since the control signal Gcp1 is in L level and the transmission gate 42 in each column is turned off, the supply of the data signal does not affect the electric potential of the node h.

In the embodiment, the electric potential Vini is set so as to be smaller than a value obtained by subtracting threshold voltage |Vth| of the transistor 121 from the electric potential Vel on the high potential side of the power supply, for example.

$$Vini < Vel - |Vth| \quad (5)$$

As described above, the transistor 121 is a P-channel type. In the transistor 121, the threshold voltage Vth as a reference of the electric potential of the source node is a negative value, and in order to prevent confusion in the description of a high-low relationship, the threshold voltage is shown as |Vh| as an absolute value, and regulated by a magnitude relationship.

Compensation Period

The scanning period in the i-th row becomes the compensation period of (c) after the initialization period of (b). As shown in FIG. 4, in the compensation period of (c) compared to the initialization period of (b), the scanning signal Gwr(i) and the control signal Gcmp(i) are in L level, and the control signal /Gini is in H level in a state where the control signal Gref is maintained to be in H level.

Figure 7:
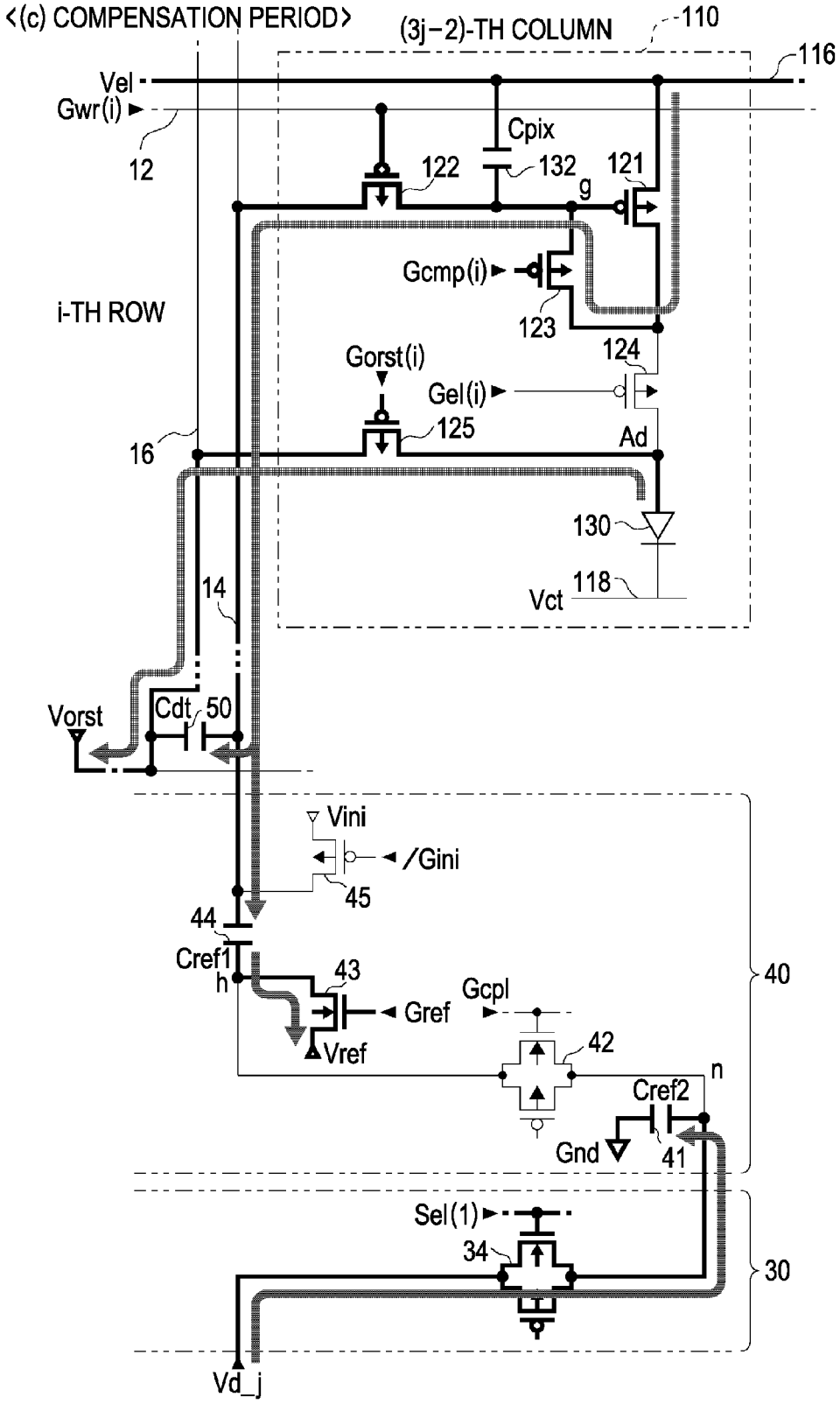
FIG. 7 is an explanatory view of an operation of the electro-optic device.

Accordingly, as shown in FIG. 7, in the level shift circuit 40, since the transistor 43 is continuously turned on, the node h is maintained to have the electric potential Vref.

On the other hand, since the gate node g is electrically connected to the data line 14 by turning off the transistor 45 and by turning on the transistor 122 in the pixel circuit 110 in the i-th row by the (3j−2)-th column, in the path from the data line 14 to the gate node g, the electric potential when the compensation period starts is set as the electric potential Vini.

Herein, since the transistor 123 is turned on in the compensation period, the transistor 121 is connected to a diode. In addition, in a path from the data line 14 to the gate node g, the electric potential when the compensation period starts is the electric potential Vini which satisfies Equation (5).

Accordingly, drain electric current flows to the transistor 121 to charge the gate node g and the data line 14. In detail, the electric current flows in a path of the feeder line 116→the transistor 121→the transistor 123→the transistor 122→the data line 14 in the (3j−2)-th column. Accordingly, the electric potential in the path from the data line 14 to the gate node g which is in a connected state by turning on the transistor 121 is increased from the electric potential Vini.

However, since it is difficult for the electric current flowing in the path described above to flow as the gate node g approaches the electric potential (Vel−|Vth|), the data line 14 and the gate node g is saturated with the electric potential (Vel−|Vth|) until the compensation period ends. Accordingly, the voltage held by both ends of the holding capacitor 132, that is, the voltage between the gate and the source of the transistor 121 is the threshold voltage |Vth| of the transistor 121 until the compensation period ends.

FIGS. 11A to 11D are views which illustrate the electric potential of the node n, the node h, and the gate node g of the compensation period and the writing period.

Figure 11A:
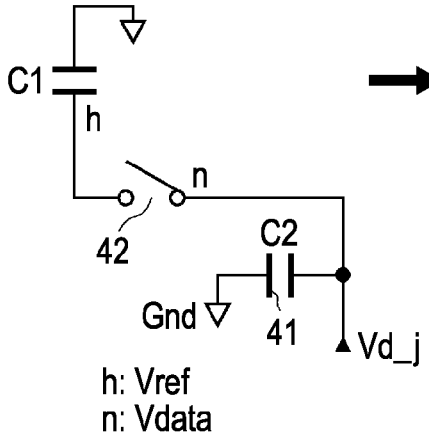
FIGS. 11A to 11D are views schematically showing operations of the equivalent circuit with various capacitance items.

In the compensation period, since the control signal Gcp1 is continuously in L level from the initialization period (since the control signal /Gcp1 is in H level), the transmission gate 42 is turned off. In addition, the data signal Vd_j supplied through the demultiplexer 30 is held by the holding capacitor 41. At that time, if the electric potential of the data signal Vd_j is Vdata, as shown in FIG. 11A, the electric potential of the node n which is one end of the holding capacitor 41 becomes the electric potential Vdata.

In addition, the electric potential of the node h which is the other end of the holding capacitor 44, that is, one end of the synthetic capacitance C1, is the electric potential Vref by turning on the transistor 43. In addition, at the time when the compensation period ends, as described above and as shown in FIG. 11B, the gate node g is saturated with the electric potential (Vel−|Vth|).

Writing Period

The scanning period in the i-th row becomes the writing period of (d) after the compensation period of (c). As shown in FIG. 4, in the writing period of (d), the control signal Gref is in L level, and on the other hand, the control signal Gcp1 is in H level (the control signal /Gcp1 is in L level).

In addition, in the embodiment, the control signals Sel(1), Sel(2) and Sel(3) do not become to be in H level in the writing period (control signals /Sel(1), /Sel(2), and /Sel(3) do not become to be in L level).

Figure 8:
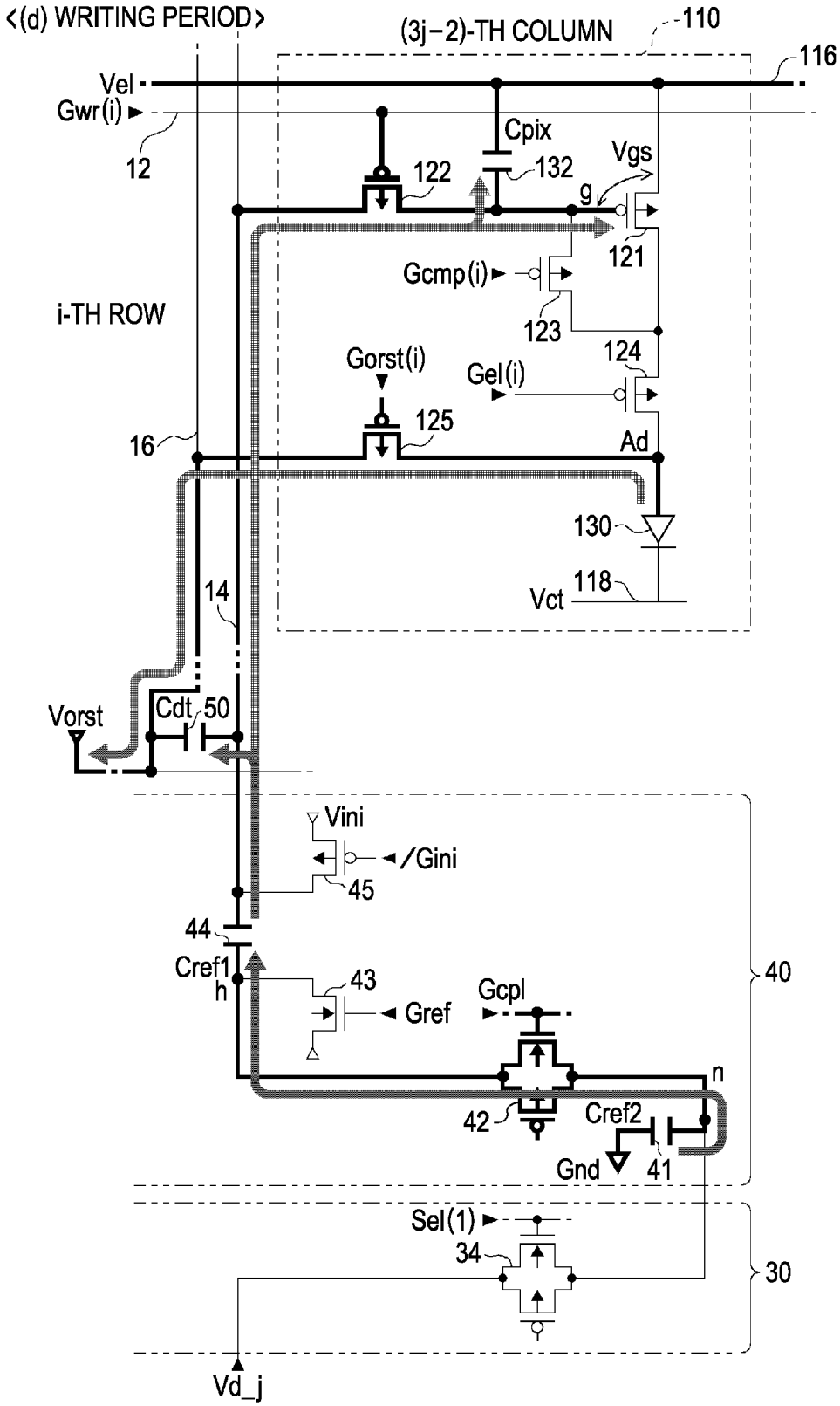
FIG. 8 is an explanatory view of an operation of the electro-optic device.

Accordingly, as shown in FIG. 8, in each column, since the transmission gate 42 is turned on in a state where the transmission gate 34 is turned off, the electric potential of the node h which is one end of the synthetic capacitance C1 is shifted from the electric potential Vref in the compensation period.

Figure 11C:
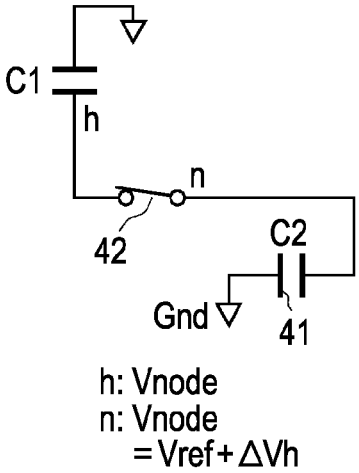
Figure 11B:
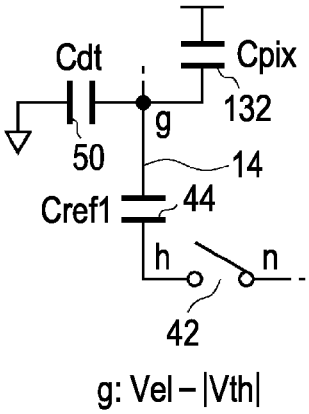

Herein, the electric potential shifting of the node h will be described with reference to FIG. 11C. In the writing period, the electric potential of the node n and the node h are electric potential Vnode which is the same for each other, by turning on the transmission gate 42.

Accordingly, since electric charge stored in the holding capacitor 41, in detail, electric charge corresponding to the sum of the electric potential Vdata and the capacitance C2 is divided again into the synthetic capacitance C1 in which the electric charge corresponding to the electric potential Vref is stored by turning on the transmission gate 42 and own capacitance C2, Equation (6) in FIG. 12 is satisfied.

When solving Vnode, Equation (6) can be expressed as Equation (7) in the drawing.

Herein, when the electric potential shift amounts from the initialization period to the writing period in the node h is set as ΔVh, Vnode can be expressed as shown in Equation (8).

In addition, when the increasing direction is set to be positive, in the embodiment, the electric potential shift amounts ΔVh is changed to a decreasing direction, and thus, is negative.

When solving the electric potential shift amount ΔVh, Equation (9) is introduced from Equation (7) and Equation (8). When C2/(C1+C2) in Equation (9) is set as a ratio k as shown in Equation (3), the electric potential shift amounts ΔVh of the node h can be expressed as shown in Equation (10).

In addition, in the writing period, the control signal Gcmp(i) is in H level as shown in FIG. 4. Accordingly, as shown in FIG. 8, the diode connection of the transistor 121 is released. On the other hand, the state where the gate node g is connected to one end of the holding capacitor 44 through the data line 14 is continued from the compensation period. Accordingly, the gate node g is shifted from the electric potential (Vel−|Vth|) of the compensation period, by a value obtained by multiplying a coefficient p by the electric potential shift amount ΔVh of the node h.

Figure 11D:
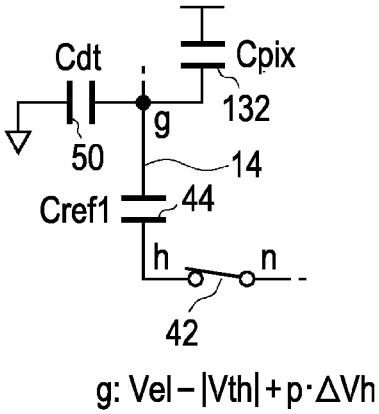

Herein, when describing the electric potential shift of the gate node g with reference to FIG. 11D, since the electric potential shift amount ΔVh of the node h is set as a value which is obtained by internally dividing parallel capacitance (Cdt+Cpix) of the holding capacitors 50 and 132 and the capacitance Cref1 of the holding capacitor 44, an electric potential shift amount ΔVg can be expressed as shown in Equation (11) in FIG. 12.

That is, as shown in Equation (11), the electric potential shift amount ΔVg is determined by the capacitance Cdt, Cref1, and Cpix, and the electric potential shift amount ΔVh of the node h. The electric potential shift amount ΔVh is determined by the electric potential Vdata and Vref, and the ratio k, as shown in Equation (10). Among them, the electric potential Vdata is electric potential of the data signal and changes from V(0) corresponding to the gradation level "0" to V(255) corresponding to the gradation level "255" in a stepwise manner, however, since other values are constant values, the electric potential shift amount ΔVg is determined according to the gradation level.

If a coefficient of the ΔVh is set as p in Equation (11), the electric potential shift amount ΔVg of the gate node g can be simply expressed as shown in Equation (12). Accordingly, the shifted electric potential Vg of the gate node g can be expressed as shown in FIG. 11D or Equation (14) in FIG. 12.

In addition, the electric potential shift amount ΔVg of the gate node g can be expressed as shown in Equation (13) from Equation (9) and Equation (11). When the increasing direction is set to be positive, in the embodiment, the electric potential shift amount ΔVg is changed to a decreasing direction in the same manner as the electric potential shift amount ΔVh, and thus, is negative.

In addition, the voltage Vgs of the transistor 121 when the compensation period ends is a value (|Vth|−p·ΔVh) which is obtained by being shifted by the electric potential shift amount of the gate node g from the threshold voltage |Vth|.

Light Emitting Period

After the writing period in i-th row ends, the period reaches the light emitting period with an interval in one horizontal scanning period. In this light emitting period, since the control signal Gel(i) is in L level as described above, the transistor 124 is turned on in the pixel circuit 110 in the i-th row by the (3j−2)-th column.

The voltage Vgs between the gate and the source is (|Vth|−p·ΔVh), and is a value obtained by being shifted by an amount corresponding to the electric potential of the data signal from the threshold voltage of the transistor 121. Accordingly, as previously shown in FIG. 5, the electric current corresponding to the gradation level is supplied to the OLED 130 in a state in which the threshold voltage of the transistor 121 is compensated.

In the scanning period in the i-th row, the operations from the initialization period and the light emitting period as described above are executed in parallel temporally even in pixel circuits 110 in the i-th row other than the pixel circuit 110 in the (3j−2)-th column. However, in the demultiplexer 30, since the selection signals Sel(1), Sel(2), and Sel(3) become to be in H level in order, the electric potential of the data signal is held in order from (3j−2)-th column, (3j−1)-th column, and (3j)-th column in a case of the j-th group, by the holding capacitor 41.

Further, in practice, the operations in the i-th row described above are executed in order from 1, 2, 3, . . . , (m−1)-th, m-th row in one frame period and are repeated for each frame.

In the embodiment, since an effect of the threshold voltage of the electric current Ids supplied to the OLED 130 by the transistor 121 is offset, although the threshold voltage of the transistor 121 varies for each pixel circuit 110, the variation thereof compensated and the electric current corresponding to gradation level is supplied to the OLED 130. Thus, according to the embodiment, since the generation of display unevenness to lose uniformity on the display screen is suppressed, it is possible to display with a high quality.

Figure 14:
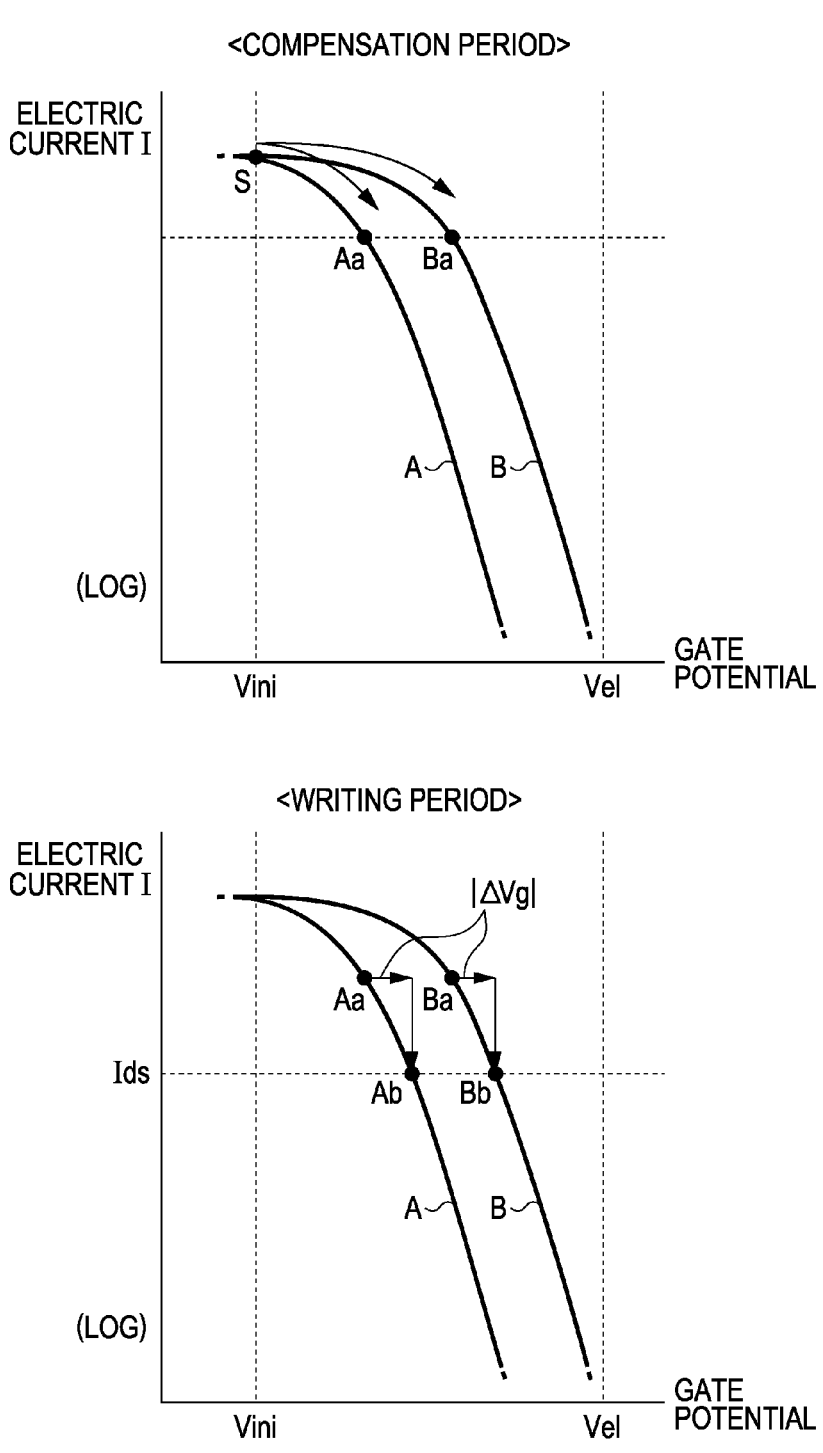
FIG. 14 is a view showing properties of transistors of the electro-optic device.

The offsetting thereof will be described with reference to FIG. 14. As shown in the drawing, in order to control minute electric current to be supplied to the OLED 130, the transistor 121 is operated in a weak inversion region (subthreshold region).

In the drawing, A shows a transistor with large threshold voltage |Vth| and B shows a transistor with small threshold voltage |Vth|, respectively. In addition, in FIG. 14, the voltage Vgs between the gate and the source is a difference between the properties shown with a solid line and the electric potential Vel. Further, in the drawing, the electric current in a longitudinal scale is shown with a log by setting a direction from the source to the drain as a positive (upper) direction.

The electric potential of the gate node g in the compensation period becomes the electric potential (Vel−|Vth|) from the electric potential Vini of the data line 14. Accordingly, in the transistor A with large threshold voltage |Vth|, an operating point moves from S to Aa, and on the other hand, in the transistor B with small threshold voltage |Vth|, the operating point moves from S to Ba.

Next, in a case where the electric potential of the data signals to the pixel circuits 110 to which two transistors belongs are the same with each other, that is, in a case where the same gradation level is designated, in the writing period, the electric potential shift amounts from the operating points Aa and Ba are |ΔVg|(=|p·ΔVh|) which is same for both. Accordingly, the operating point of the transistor A moves from Aa to Ab, and the operating point of the transistor B moves from Ba to Bb, however, the electric current of the operating points after electric potential shifting is set to be Ids which is substantially the same for both transistors A and B.

In addition, in the embodiment, a ratio (compression ratio) to compress the amplitude of the electric potential of the data line 14 (gate node g) with respect to the amplitude of the data signal is set so as to be different for each column of RGB. In detail, the compression ratio becomes higher in order from G, R, and B, that is, the amplitude of the electric potential of the data line 14 (gate node g) becomes smaller in order from G, R, and B.

Figure 13:
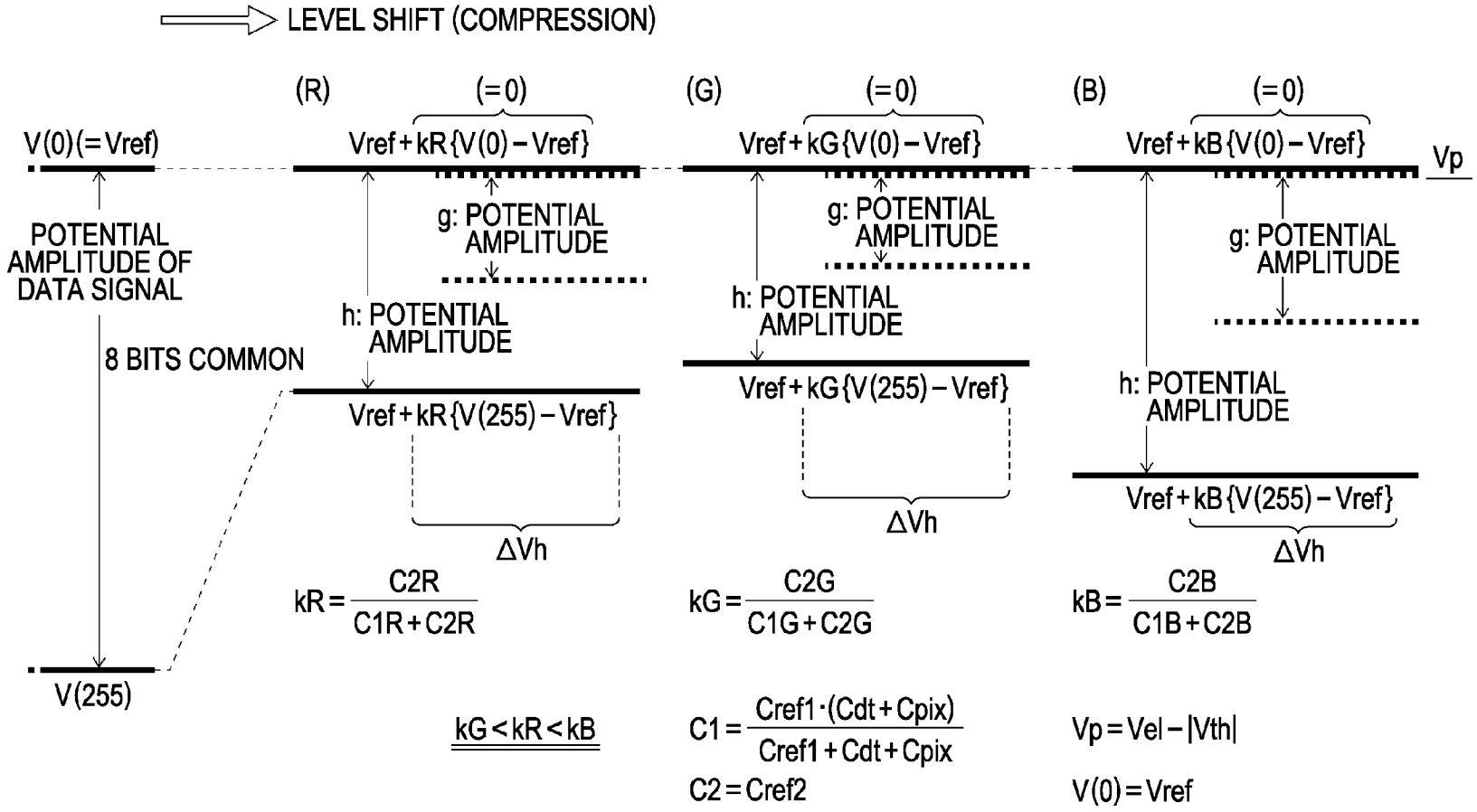
FIG. 13 is a view showing setting states of level shift of the electro-optic device.

FIG. 13 is a view showing a relationship between the electric potential amplitude of the data signal and the electric potential amplitude of the node h and the gate node g for each RGB. In addition, in the drawing, the electric potential amplitude of the node h is shown with a solid line, and the electric potential amplitude of the gate node g is shown with a broken line.

When the data signal Vd_j of the electric potential Vdata is supplied from the control circuit 5 as described above, the electric potential shift amount ΔVh of the node h is expressed as shown in Equation (10). Herein, the electric potential Vdata of the data signal changes from V(0) to V(255). However, since the electric potential Vref is set to be equivalent to the V(0) of the data signal as shown in Equation (4), when the electric potential Vdata of the data signal is V(0), the value in the right bracket in Equation (10) becomes zero. Accordingly, if the electric potential of the data signal is V(0), since the electric potential shift amount ΔVh becomes zero, as shown in FIG. 13, the electric potential of the node h does not shift from V(0) (=Vref) for each RGB.

Thus, since the electric potential shift amount ΔVg shown in Equation (12) is zero, the electric potential Vg of the gate node g shown in Equation (13) does not change from the electric potential (Vel−|Vth|) when the compensation period ends. Accordingly, if the electric potential of the data signal is V(0), in the light emitting period, since the electric current does not flow to the OLED 130 for each color of RGB, it is possible to perform excellent black display.

On the other hand, when the electric potential of the data signal is the lowest V(255), the electric potential shift amount ΔVh of the node h is set as a value obtained by multiplying ratios kR, kG, and kB for each RGB by {V(255)−Vref} as shown in Equation (10) and FIG. 13. Herein, since V(255) is lower than V(0) and Vref, the value in bracket becomes negative. Accordingly, when the electric potential of the data signal is V(255), as shown in FIG. 13, the electric potential of the node h shown in the right side of Equation (8) is lower than the Vref in order from B, R, and G, according to the size of the ratios kR, kG, and kB.

The electric potential shift amounts ΔVg shown in the gate node g is also proportional to ΔVh in the right side of Equation (11), and thus becomes lower than Vref in order from B, R, and G as shown in FIG. 13.

Accordingly, although the range from the electric potential V(0) to the electric potential V(255) which is the electric potential amplitude of the data signal is common for RGB, the electric potential amplitude of the gate node g is compressed so as to be different for each RGB with V(0) and Vref as references. That is, if the OLED is set according to the electric potential of the gate node g at the time of emitting light with maximum brightness, it is possible to set the electric potential amplitude of the data signal common in RGB.

Herein, since the electric potential shift amounts ΔVg of the gate node g is shown in Equation (13), it is only necessary to set a coefficient portion determined by the synthetic capacitance C1 and the capacitance C2 (=Cref2) for each RGB.

As shown in Equation (9) or FIG. 13, the electric potential shift amount ΔVh in a case of the electric potential V(255) of the data signal with respect to the gradation level "255", for example, is set as a value obtained by multiplying the ratios kR, kG, and kB of the capacitance by {V(255)−Vref}, respectively. Herein, when providing the synthetic capacitance C1 for each RGB, it is only necessary to set the capacitance Cref2 of the holding capacitor 41 according to the electric potential Vg of the gate node g required for each RGB so as to satisfy kG<kR<kB.

As described above, according to the embodiment, since the level of the data signal common for each RGB is shifted with the compression ratios which are different for each RGB to be supplied to the data line 14 and the gate node g, it is not necessary to perform a process with bit numbers larger than 8 bits to regulate the gradation levels. Accordingly, according to the embodiment, it is possible to avoid a complicated configuration.

In addition, when the pixel circuit is subjected to a refinement, in the transistor 121, the drain electric current significantly changes in an exponential manner with respect to the change of the voltage Vgs between the gate and the source, however, in the embodiment, since the electric potential amplitude of the data signal is compressed and supplied to the data line 14 and the gate node g, it is possible to control the electric current to be supplied to the OLED 130 with high precision with respect to the change of the electric potential of the data signal.

In addition, in the embodiment, the data signal supplied from the control circuit 5 in the initialization period and the compensation period is sequentially held by the holding capacitor 41 which is for three columns in each group, and the level thereof is collectively shifted and supplied with respect to the data line 14 of each column, by turning on the transmission gate 42 in the writing period. Accordingly, in the embodiment, even with a configuration to distribute the data signal by the demultiplexer 30, since the difference is difficult to be generated when comparing the data lines 14 which configure the same group, unevenness of the display is difficult to be generated.

Application and Modification Example

The invention is not limited to embodiments such as the embodiment or the application example, and various modifications can be performed as will be described later, for example. In addition, the modified embodiment which will be described later can be suitably combined with one or a plurality of embodiments selected arbitrarily.

Omission of Capacitance Cref2

In the embodiment, the holding capacitor 41 (capacitance Cref2) and the transmission gate 42 are provided for each column, however they are not always necessary. That is because, it is only necessary to change the electric potential of the data line 14 (gate node g) by the change of the electric potential of the node h through the holding capacitor 44.

Even with a case where the holding capacitor 41 and the transmission gate 42 are not provided for each column, as shown in Equation (14), the electric potential Vg of the data line 14 (gate node g) is shifted by a value obtained by multiplying a coefficient p by the electric potential shift amount ΔVh of the node h, that is, (Vdata−Vref) in the configuration, from (Vel−|Vth|) when the compensation period ends. Herein, the coefficient p is a coefficient portion of ΔVh in the right side of Equation (11).

Accordingly, when the capacitance Cpix of the holding capacitor 132 is small to be ignored in the configuration, it is only necessary to suitably set the ratio of the capacitance Cref1 and the capacitance Cdt.

In addition, in a case of not providing the holding capacitor 41 and the transmission gate 42, in the writing period, the transmission gates 34 is turned on sequentially from the left end column, the center column, and the right end column in each group to distribute and supply the data signal. Accordingly, in the configuration, the long writing period is necessary, such that the compensation period becomes shorter by that extent, compared to the embodiment in which the transmission gates 42 are collectively turned on in the writing period.

Control Circuit

In the embodiment, the control circuit 5 which supplies the data signal is configured to be separated from the electro-optic device 10, however the control circuit 5 may be integrated in the semiconductor silicon substrate with the scanning line driving circuit 20, the multiplexer 30, and the level shift circuit 40.

Substrate

In the embodiment, the electro-optic device 10 is configured to be integrated in the semiconductor silicon substrate, but, may be configured to be integrated in the other semiconductor substrate. For example, an SOI substrate may be used. In addition, polysilicon process may be applied to form a glass substrate or the like.

Control Signal Gcmp(i)

In the embodiment, the control signal Gcmp(i) is in H level in the writing period in a case of i-th row, but may be in L level. That is, the compensation of the threshold value and the writing to the node gate g by turning on the transistor 123 may be executed in parallel with each other.

Demultiplexer

In the embodiment, the data lines 14 are set to be a group with three columns, and the data lines 14 are sequentially selected in each group to supply the data signal, however, numbers of the data lines configuring the group may be "2", or "4" or more.

In addition, other than the configuration in that the data signal is distributed by the demultiplexer 30, a configuration in that the data signal supplied from the control circuit 5 is temporarily held in the holding capacitor 41, and then is supplied to the data line 14 through the holding capacitor 44 by turning on the transmission gate 42, may be employed. In addition, in a case of not providing the holding capacitor 41 and the transmission gate 42, the data signal in the writing period is supplied to the node h which is initialized to the electric potential Vref.

Channel Type of Transistor

In the embodiment described above, the transistors 121 to 125 of the pixel circuit 110 is unified to be P-channel type, however may be unified to be N-channel type. In addition, the P-channel type and the N-channel type may be suitably combined.

Others

In the embodiment, the OLED is corresponded to three colors of RGB for color display, however, may be corresponded to four colors by adding Y (yellow) or to colors other than RGB, for example. In addition, in a case where it is not necessary to display a full-color image, when text information is displayed as electric bulletin board, for example, two colors of GR may be corresponded, for example.

In the embodiment, the OLED which is a light emitting element has been used as the electro-optic element, however, an element such as an inorganic light emitting diode or a Light Emitting Diode (LED) may be used as long as it emits light with brightness based on the electric current.

Electronic apparatus

Next, an electronic apparatus to which the electro-optic device 10 according to the embodiment or the application example is applied will be described. The electro-optic device 10 is suitable for display with high precision with a small pixel size. The electronic apparatus will be described with a Head Mounted Display (HMD) as an example.

Figure 15:
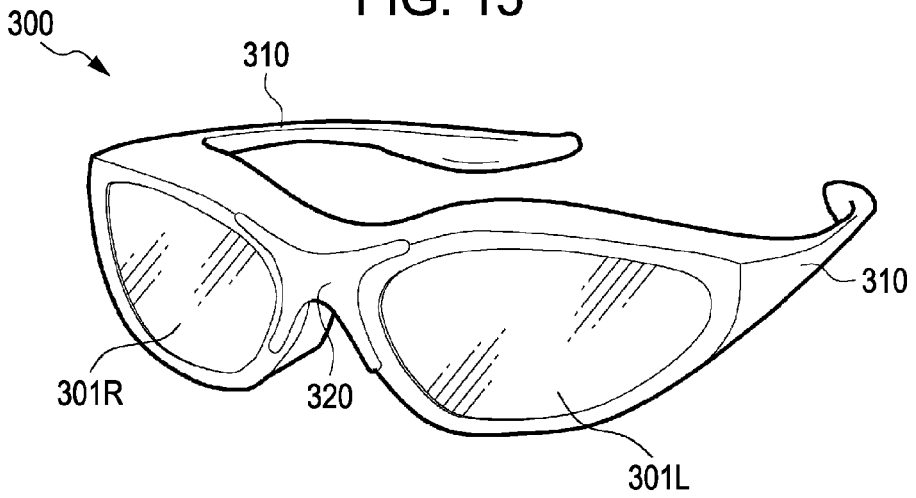
FIG. 15 is a perspective view showing a Head Mounted Display (HMD) using an electro-optic device according to an embodiment.
Figure 16:
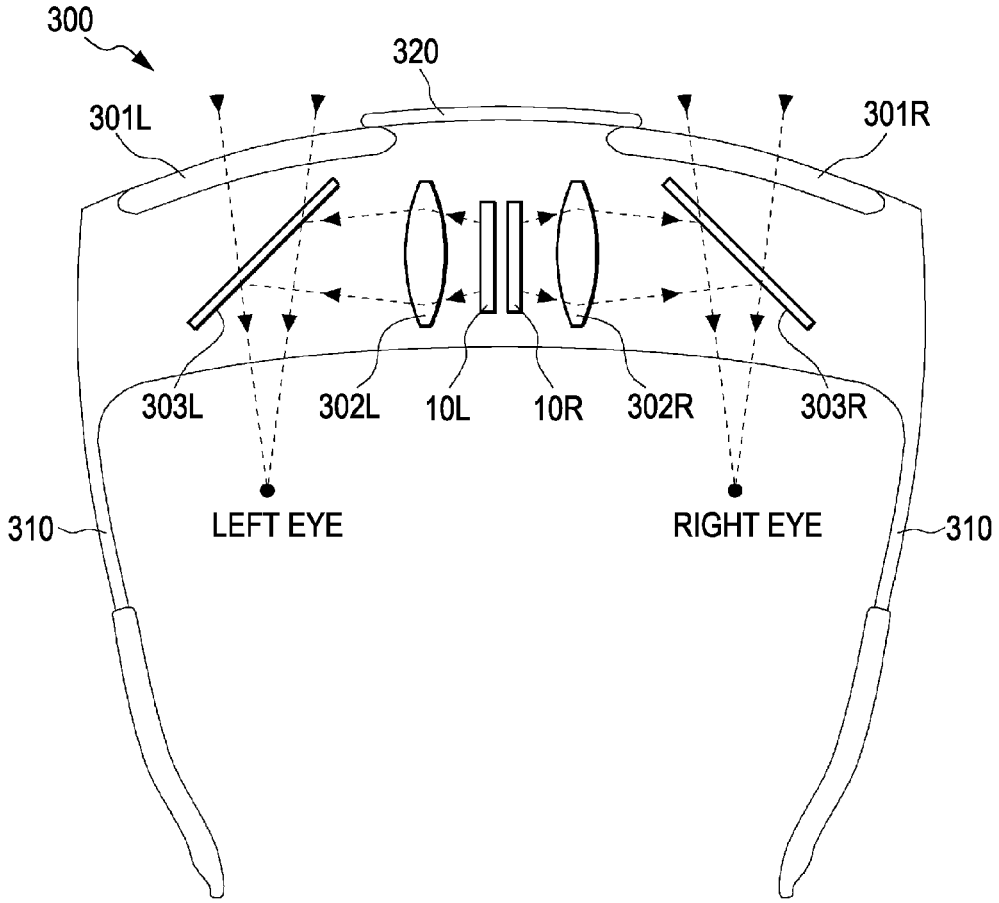
FIG. 16 is a view showing an optical configuration of the HMD.

FIG. 15 is a view showing appearance of the HMD, and FIG. 16 is a view showing an optical configuration. First, as shown in FIG. 15, the HMD 300 externally includes a temple 310, a bridge 320, lenses 301L and 301R, as in the same manner as general glasses. In addition, as shown in FIG. 16, in the HMD 300, an electro-optic device 10L for a left eye and an electro-optic device 10R for a right eye are provided in the vicinity of the bridge 320 and inside (lower side of the drawing) the lenses 301L and 301R.

An image display surface of the electro-optic device 10L is disposed so as to be a left side in FIG. 16. Accordingly, a display image by the electro-optic device 10L is output to a direction of 9 o'clock in the drawing through an optical lens 302L. A half mirror 303L reflects the display image by the electro-optic device 10L in a direction of 6 o'clock, and on the other hand, transmits light entered from a direction of 12 o'clock.

An image display surface of the electro-optic device 10R is disposed so as to be a right side which is the opposite to the electro-optic device 10L. Accordingly, a display image by the electro-optic device 10R is output to a direction of 3 o'clock in the drawing through an optical lens 302R. A half mirror 303R reflects the display image by the electro-optic device 10R in a direction of 6 o'clock, and on the other hand, transmits light entered from a direction of 12 o'clock.

In the configuration, a wearer of the HMD 300 can observe the display image by the electro-optic devices 10L and 10R in a see-through state to overlap with outer appearance.

In addition, in the HMD 300, from images of both eyes with disparity, if an image for a left eye is displayed on the electro-optic device 10L, and an image for a right eye is displayed on the electro-optic device 10R, it is possible for a wearer to sense the displayed image so as to have a depth or a stereoscopic effect (3D display).

In addition, other than the HMD 300, the electro-optic device 10 can be applied to an electronic viewfinder such as a video camera or a digital camera with interchangeable lenses.

The entire disclosure of Japanese Patent Application No. 2012-099994, filed Apr. 25, 2012 is expressly incorporated by reference herein.

What is claimed is:

1. An electro-optical device comprising:

a control circuit that converts digital image data into an analog data signal and that outputs the data signal;

a first switch provided with a first input end connected to the control circuit and a first output end;

a second switch provided with a second input end connected to the control circuit and a second output end;

a first capacitor having a first end connected to the first output end of the first switch;

a second capacitor having a second end connected to the second output end of the second switch;

a third switch provided with a third input end coupled to the first end of the first capacitor and a third output end;

a fourth switch provided with a fourth input end coupled to the second end of the second capacitor and a fourth output end;

a third capacitor having a third end connected to the third output end of the third switch and a fourth end;

a fourth capacitor having a fifth end connected to the fourth output end of the fourth switch and a sixth end;

a first wiring connected to the fourth end of third capacitor;

a second wiring connected to the sixth end of fourth capacitor;

a fifth capacitor having a seventh end connected to the first wiring;

a sixth capacitor having a eighth end connected to the second wiring;

a third wiring;

a first pixel circuit formed at a first position corresponding to an intersection of the first wiring and the third wiring;

a second pixel circuit formed at a second position corresponding to an intersection of the second wiring and the third wiring, wherein each of the first pixel circuit and the second pixel circuit includes:

a light emitting element;

a first transistor controlling current supplied to the light emitting element when electrically connected to the light emitting element;

a second transistor which is electrically connected between the first wiring or the second wiring and a gate of the first transistor and which is configured to be turned on or off, and a pixel capacitor connected to the gate of the first transistor.

2. The electro-optical device according to claim 1, wherein capacitance of the second storage capacitor is different from capacitance of the first storage capacitor.

3. An electronic apparatus comprising the electro-optic device according to claim 2.

4. The electro-optical device according to claim 1, wherein capacitance ratio of the third capacitor to the fifth capacitor is different from capacitance ratio of the fourth capacitor to the sixth capacitor.

5. An electronic apparatus comprising the electro-optic device according to claim 4.

6. The electro-optical device according to claim 1, wherein the data signal supplied to the first capacitor is compressed with a first compression rate by using the first capacitor, the third switch, the third capacitor, the first wiring, and the fifth capacitor, and wherein a first compressed signal is supplied to the third end of the third capacitor.

7. An electronic apparatus comprising the electro-optic device according to claim 6.

8. The electro-optical device according to claim 6, wherein the first compressed signal is compressed with a third compression rate by using the third capacitor, the first wiring, and the fifth capacitor, and wherein the third compressed signal is supplied to the gate of the first transistor in the first pixel circuit.

9. An electronic apparatus comprising the electro-optic device according to claim 8.

10. The electro-optical device according to claim 6, wherein the data signal supplied to the second capacitor is compressed with a second compression rate different from the first compression rate by using the second capacitor, the fourth switch, the fourth capacitor, the second wiring, and the sixth capacitor, and wherein a second compressed signal is supplied to the fifth end of the fourth capacitor.

11. An electronic apparatus comprising the electro-optic device according to claim 10.

12. The electro-optical device according to claim 10, wherein the second compressed signal is compressed with a fourth compression rate by using the fourth capacitor, the second wiring, and the sixth capacitor, and wherein the fourth compressed signal is supplied to the gate of the first transistor in the second pixel circuit.

13. An electronic apparatus comprising the electro-optic device according to claim 12.

14. The electro-optical device according to claim 1, wherein the electric potential shift of the gate of the first transistor is set as a value which is obtained by divide the electric potential shift of the third end of the third capacitor by parallel capacitance of the fifth capacitor and the pixel capacitor of the first pixel circuit and capacitance of the third capacitor.

15. An electronic apparatus comprising the electro-optic device according to claim 14.

16. The electro-optical device according to claim 1, wherein the control circuit turn on the third switch so that a first electric charge supplied to the third end of third capacitor and a second electric charge, which corresponds the data signal, supplied to the first capacitor is divided by the first capacitor, the third capacitor, and the fifth capacitor.

17. An electronic apparatus comprising the electro-optic device according to claim 16.

18. An electronic apparatus comprising the electro-optic device according to claim 1.

* * * * *